US007975610B2

(12) United States Patent
Stiel

(10) Patent No.: US 7,975,610 B2
(45) Date of Patent: Jul. 12, 2011

(54) PRINTING UNITS COMPRISING SEVERAL PRINTING GROUPS, AND PRINTING TOWER

(75) Inventor: Jürgen Alfred Stiel, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 585 days.

(21) Appl. No.: 12/084,767

(22) PCT Filed: Jan. 24, 2007

(86) PCT No.: PCT/EP2007/050694

§ 371 (c)(1), (2), (4) Date: May 9, 2008

(87) PCT Pub. No.: WO2007/088132

PCT Pub. Date: Aug. 9, 2007

(65) Prior Publication Data

US 2009/0255428 A1 Oct. 15, 2009

(30) Foreign Application Priority Data

Jan. 31, 2006 (DE) ..... 10 2006 004 330

(51) Int. Cl.
*B41F 27/12* (2006.01)

(52) U.S. Cl. ..... 101/477; 101/219

(58) Field of Classification Search ..... 101/477
See application file for complete search history.

(56) References Cited

U.S. PATENT DOCUMENTS

| | | | | |
|---|---|---|---|---|
| 4,905,595 | A | 3/1990 | Jeschke | |
| 5,699,735 | A | 12/1997 | Stein et al. | |
| 5,842,414 | A * | 12/1998 | Yoshida et al. | 101/136 |
| 6,854,392 | B2 * | 2/2005 | Tobe | 101/477 |
| 7,156,019 | B2 | 1/2007 | Herbert et al. | |
| 7,182,022 | B2 | 2/2007 | Schneider et al. | |
| 7,322,290 | B2 * | 1/2008 | Zink | 101/477 |
| 7,357,079 | B2 | 4/2008 | Rachor et al. | |
| 2003/0172829 | A1 * | 9/2003 | Fukui et al. | 101/477 |
| 2005/0005796 | A1 * | 1/2005 | Nakano et al. | 101/477 |

FOREIGN PATENT DOCUMENTS

| | | |
|---|---|---|
| DE | 37 21 879 A1 | 1/1989 |
| DE | 37 21 879 C2 | 1/1989 |
| DE | 43 22 027 A1 | 1/1995 |
| DE | 198 04 106 A1 | 8/1999 |
| DE | 10 2004 052 020 | 5/2006 |

(Continued)

*Primary Examiner* — Anthony H. Nguyen

(74) *Attorney, Agent, or Firm* — Jones, Tullar & Cooper, P.C.

(57) ABSTRACT

The invention relates to a printing unit (16; 17) comprising several printing groups (03; 04; 21; 22; 28; 29; 31; 32), each of which is provided with at least one plate cylinder (07) and at least one transfer cylinder (06) that is arranged so as to cooperate directly with the plate cylinder (07). The printing unit (16; 17), which is embodied as a nine-cylinder satellite printing unit (16; 17), is equipped with four plate cylinders (07) and a counterpressure cylinder (18) that is configured as a satellite cylinder (18). At least one inking roller of an inking group (09) is disposed so as to cooperate directly with the plate cylinder (07). One respective plate replacing mechanism (11; 11*a*; 11*b*), which encompasses a front section facing the associated plate cylinder (07), is assigned to at least two plate cylinders (07) that are placed next to each other in a horizontal direction.

32 Claims, 20 Drawing Sheets

FOREIGN PATENT DOCUMENTS

| | | | |
|---|---|---|---|
| DE | 20 2005 021 002 | | 2/2007 |
| EP | 0 710 558 | A1 | 5/1996 |
| GB | 2 279 909 | A | 1/1995 |
| JP | 58188657 | A | 11/1983 |
| WO | WO 03/031180 | A2 | 4/2003 |
| WO | WO 2004/080716 | A1 | 9/2004 |
| WO | WO 2004/085160 | A1 | 10/2004 |
| WO | WO 2005/105444 | A2 | 11/2005 |

* cited by examiner

PRINTING UNITS COMPRISING SEVERAL PRINTING GROUPS, AND PRINTING TOWER

CROSS-REFERENCE TO RELATED APPLICATIONS

This application is the U.S. national phase, under 35 USC 371, of PCT/EP2007/050694, filed Jan. 24, 2007; published as WO 2007/088132 A2 on Aug. 9, 2007 and claiming priority to DE 10 2006 004330.8, filed Jan. 31, 2006, the disclosures of which are expressly incorporated herein by reference.

FIELD OF THE INVENTION

The present invention is directed to printing units comprising a plurality of printing groups and to a printing tower. The printing unit has a plurality of printing groups, each with at least one transfer cylinder and one plate cylinder. The printing units may be configured as nine-cylinder satellite units. Two such printing units can be situated one above the other to form the printing tower.

BACKGROUND OF THE INVENTION

A printing unit, which is configured as an H-printing unit, is known from WO 2004/080716 A1. Also known from this publication is the technique of feeding a printing plate to a plate cylinder in an angular area between the dampening unit assigned to that plate cylinder and the inking unit assigned to that cylinder.

A device for changing the printing plates of the plate cylinder of a printing press, which can have multiple plate cylinders, is known from WO 2004/085160 A1. The plate changing device can comprise a storage tray with an infeed chute and a removal chute. The respective storage tray can be positioned above or below a horizontal line that extends through the rotational axis of the plate cylinder to which the plate changing device is assigned. The publication further describes a printing tower with U-printing units that are placed one above another. A plate changing device, which comprises a storage tray, is assigned to each of the plate cylinders. The respective plate changing device that is assigned to each of the plate cylinders is always situated above a horizontal line that extends through the rotational axis of the plate cylinder to which the plate changing device is assigned. Finally, with each of the plate cylinders, this prior plate changing device is always situated on the same circumferential section of its respectively assigned plate cylinder.

EP 07 10 558 A1 and WO 03/031180 A2 each describe a nine-cylinder satellite printing unit with a paired drive for the printing groups.

DE 43 22 027 A1 describes a device for changing plates that have a beveled leading end. The beveled end of the plate, for an upper plate cylinder, points upward, and the beveled end of the plate, for a lower plate cylinder points downward. An infeed chute for the sole plate for each forme cylinder is oriented nearly horizontally.

DE 37 21 879 C2 describes a printing press with two plate cylinders which are arranged side by side. The printing plates of the right plate cylinder are removed from above, and the printing plates of the left plate cylinder are removed from below.

DE 10 2004 052 020 A1, which was published subsequent to the filing of the subject application, describes a nine-cylinder satellite printing unit with plate changing devices.

DE 198 04 106 A1 shows two plate cylinders arranged one above another. An infeed for the printing plate of the upper plate cylinder is situated below that cylinder's rotational axis. The infeed for the lower plate cylinder is situated above that cylinder's rotational axis.

SUMMARY OF THE INVENTION

The object of the present invention is to provide a printing unit comprising a plurality of printing groups, and to also provide a printing tower.

This object is attained according to the invention by the provision of printing units, each with a plurality of printing groups that include a plate cylinder and a transfer cylinder that contacts its associated plate cylinder. Each printing unit is configured as a multi-cylinder satellite printing unit. Plate changing devices are associated with the plate cylinders of each satellite printing unit. These plate changing devices are positioned with front sections either above or below a horizontal line extending through the rotational axis of the particular cylinder.

The benefits to be achieved with the present invention consist especially in that, according to the invention, the plate cylinders of a printing unit can each cooperate with a respective plate changing device, even when different plate cylinders of the printing unit, and especially of laterally opposite plate cylinders, have the same rotational directions, but are serviced from opposite sides. This is especially the case with satellite printing units, such as, for example, nine-cylinder satellite printing units, in which adjacent printing cylinders that are serviced from opposite sides have the same rotational directions.

The present invention makes it possible to assign plate changing devices to all the plate cylinders in a printing unit or a printing tower, regardless of the respective direction of rotation of the plate cylinder. This allows a plate change to be performed extremely rapidly, thereby increasing the productivity of the printing press accordingly.

BRIEF DESCRIPTION OF THE DRAWINGS

Preferred embodiments of the present invention are represented in the set of drawings and will be described in greater detail in what follows.

The drawings show.

DESCRIPTION OF THE PREFERRED EMBODIMENTS

Figure 1:
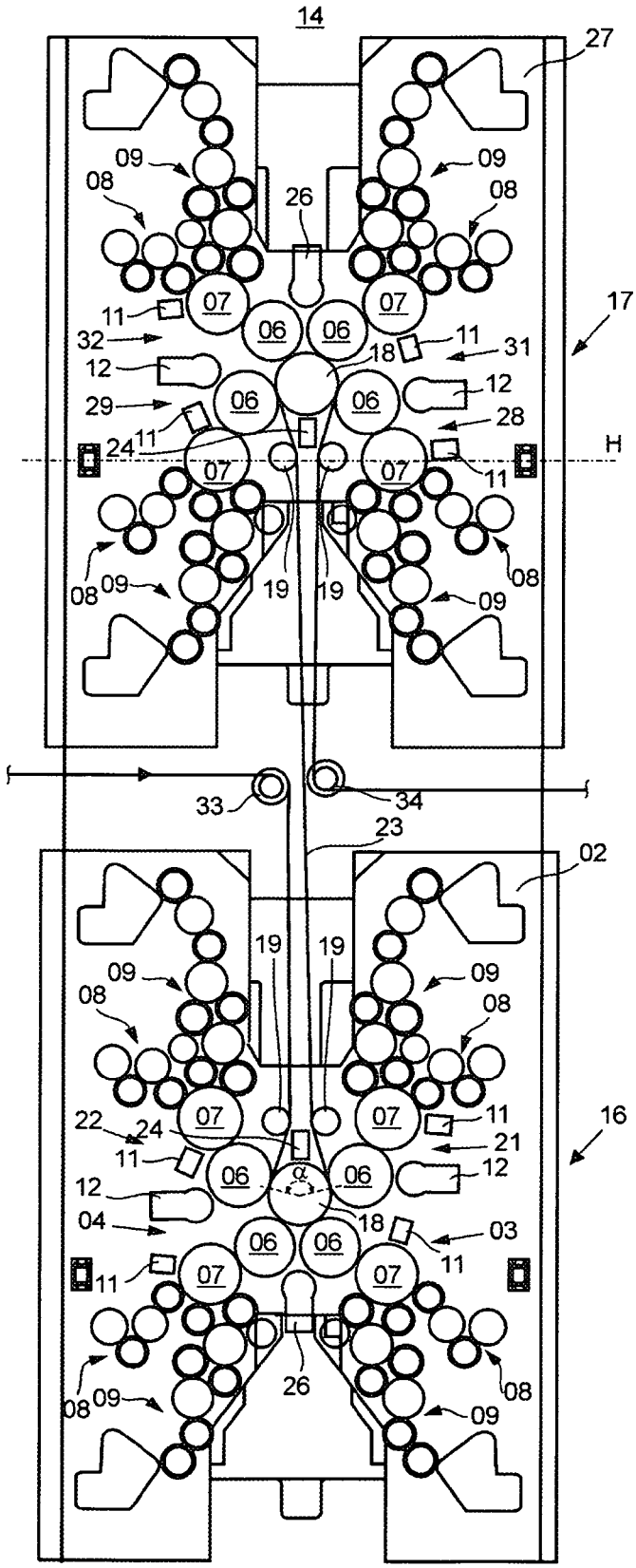
FIG. 1 a schematic side elevation view of an eight-couple printing tower with two nine-cylinder satellite printing units placed one above another, and plate changing devices for all the plate cylinders, FIG. 2 a schematic side elevation view of an alternative embodiment of an eight-couple printing tower, FIG. 3 a printing plate with a leading end that is bent at an acute angle and with a trailing end that is bent at a right angle, FIG. 4 a cross-sectional representation of a holding device for a printing plate that is mounted on a plate cylinder, FIG. 5 a schematic representation of the mounting of printing plates on a plate cylinder, FIG. 6 another schematic representation of the mounting of a printing plate on a plate cylinder, FIG. 7 a schematic side view of a printing forme magazine, FIG. 8 a schematic side view of an alternative embodiment of a printing forme magazine, FIG. 9 a side elevation view of an embodiment of a plate changing device, which feeds and/or removes printing plates to and/or from a plate cylinder from above, FIG. 10 the plate changing device of FIG. 9 with an additional printing plate to be supplied, FIG. 11 the plate changing device of FIG. 9 or FIG. 10 in a first stage of a plate changing process, FIG. 12 the plate changing device of FIG. 9 or 10 in a further stage of the plate changing process, FIG. 13 the plate changing device of FIG. 9 or 10 in a further stage of the plate changing process, FIG. 14 the plate changing device of FIG. 9 or 10 in a further stage of the plate changing process, FIG. 15 a side elevation view of an embodiment of a plate changing device, which feeds and/or removes printing plates to and/or from a plate cylinder from below, FIG. 16 a schematic side elevation view of an alternative embodiment of an eight-couple printing tower in accordance with the present invention, FIG. 17 the lower nine-cylinder satellite printing unit of the eight-couple printing tower of FIG. 16, FIG. 18 an alternative embodiment of a lower nine-cylinder satellite printing unit of an eight-couple printing tower, FIG. 19 a perspective representation of part of a satellite printing unit in accordance with FIG. 16, FIG. 20 a schematic side elevation view of an alternative embodiment of an eight-couple printing tower with nine-cylinder satellite printing units, FIG. 21 a schematic side elevation view of a further alternative embodiment of an eight-couple printing tower with nine-cylinder satellite printing units.

Referring initially to FIG. 1, there may be seen a printing tower 14, which is configured as an eight-couple printing tower 14, and is comprised of two printing units 16 and 17, and especially of nine-cylinder satellite printing units 16 and 17, which typically 6/2 printing units, arranged one above another, each unit being six plates wide. The lower nine-cylinder satellite printing unit 16, which is six plates wide, comprises a frame 02, a cylinder 18, such as, for example, a satellite or impression cylinder 18, mounted on the frame 02, two lower printing groups 03; 04 that cooperate with the satellite cylinder 18, and two upper printing groups 21; 22 that cooperate with the satellite cylinder 18.

Each printing group 03; 04; 21; 22 comprises a cylinder 06, such as, for example, a transfer cylinder 06 configured as a rubber blanket cylinder 06, a cylinder 07, such as, for example, a forme cylinder 07 configured as a plate cylinder 07, a dampening unit 08 assigned to the plate cylinder 07, and an inking unit 09 assigned to the plate cylinder 07. The dampening units 08 can, for example, be brush dampening units, film dampening units or spray dampening units. The dampening units 08 are positioned toward the outside, allowing them to be flexible in terms of choice of rotational direction in a possible subsequent resetting. In each case, two plate cylinders 07; 07 of the lower groups 03, 04; or of the upper groups 21, 22 are arranged lying side by side in a horizontal direction, and therefore lying along a shared horizontal line H.

The rubber blanket cylinders 06 of the two lower printing groups 03; 04 are spaced a short distance from one another and are placed against the satellite or impression cylinder 18. The rubber blanket cylinders 06 of the two upper printing groups 21; 22 are spaced further apart from one another, than are cylinder 06 of the two lower printing groups 02; 04 and in the case of the preferred embodiment depicted in FIG. 1 have an angular distance a of approximately 150°. The rubber blanket cylinders 06 of the two upper printing groups 21; 22 can have an angular distance a of at least 90° or at least 120° or at least 140°.

A guide roller or guide roller pair 19 is positioned between the two upper printing groups 21; 22 or between their rubber blanket cylinders 06, such that a printing substrate or paper web 23 is not drawn off by the rubber blanket cylinders 06. In other words, it does not wrap around them, which is essential to the option of using the printing tower an imprinter. Furthermore, the space between the entering and the exiting paper web 23 allows sufficient room to accommodate an impression cylinder cleaning device 24, which can optionally be installed through the wall of the frame 02. With this impression cylinder cleaning device 24, the impression cylinder 18 can be cleaned without removing the paper web 23 from the printing unit.

A blanket washing device 12 is assigned to each of the rubber blanket cylinders 06 of the printing groups 21; 22. A shared blanket washing device 26 is assigned to the two rubber blanket cylinders 06 of the two lower printing groups 03; 04, which shared blanket washing device can be adjusted vertically upward toward the two rubber blanket cylinders 06, and which can clean the two rubber blanket cylinders 06 to which it is assigned, if applicable, once the impression cylinder 18 has been removed. Other configurations of the blanket washing devices 12 are also possible.

A plate changing device 11, which is depicted schematically in FIG. 1, is assigned to each of the plate cylinders 07 of the printing groups 03; 04; 21; 22, and is usable to automate and to accelerate the mounting of printing plates on the respective plate cylinders 07. The plate changing devices 11 can be of the type described in detail below. These plate changing devices 11 are situated in each printing unit 16; 17 in such a way, for example, that at least one printing plate 101 can be fed into its respective cylinder without curvature.

The drive concept for this preferred embodiment can be based, for example, upon the use of five or six drives for the nine-cylinder satellite printing unit 16. For one reason, because of the close spatial positioning of the rubber blanket cylinders 06, or small formats, the plate cylinders 07 are preferably driven. These driven plate cylinders 07 then induce or accomplish a paired drive of the blanket cylinders 06, for example.

The structure of the upper nine-cylinder satellite printing unit 17 corresponds to that of the lower nine-cylinder satellite printing unit 16, but in a mirror-image configuration. For a detailed description thereof, reference can be made to the above. The arrangement of the printing groups 03; 04; 21; 22 and/or of the cylinders 06; 07; 18 of the one printing unit 16 is a mirror image of the arrangement of the printing groups 28; 29; 31; 32 and/or cylinders 06; 07; 18 of the other printing unit 17. Additionally, the plate changing devices 11 of one printing unit 16 are arranged in a mirror image position relative to the plate changing devices 11 of the other printing unit 17.

The upper nine-cylinder satellite printing unit 17 has a side frame 27 with bore holes, which are in a mirror-image configuration to those of the frame 02. Optionally, the frame 27 or parts thereof can be identical in configuration to the frame 02, but which are placed on the frame 02 rotated by 180°, which favorably affects production costs. Of course, rather than the two stacked frames 02; 27, a single shared frame can also be provided for the two nine-cylinder satellite printing units 16; 17 of the printing tower 14.

The upper nine-cylinder satellite printing unit 17 also comprises an impression cylinder 18 that serves as a satellite cylinder 18, and four printing groups 28; 29; 31; 32 placed against it. In this case, the rubber blanket cylinders 06 of the two lower printing groups 28; 29 are spaced far from one another, whereas the rubber blanket cylinders 06 of the two upper printing groups 31; 32 are spaced a short distance from one another. The upper two printing groups 31; 32 are arranged in the configuration of a U-printing unit.

In the eight-couple printing tower 14, the web of printing substrate 23 to be printed is fed from an entry cylinder 33 downward nearly vertically to the lower nine-cylinder satellite printing unit 16, where it is printed on one side in a four-color printing process. It is then fed upward nearly vertically to the upper nine-cylinder satellite printing unit 17, where it is printed on the other side in a four-color printing process, and is then fed downward nearly vertically to a departure or exit cylinder 34.

If the above-described printing groups 03; 04; 21; 22; 28; 29; 31; 32 that operate using the offset printing process operate using another printing process, for example an indirect intaglio printing process or a dry lithographic printing process, the dampening units 08 are, of course, omitted.

Figure 2:
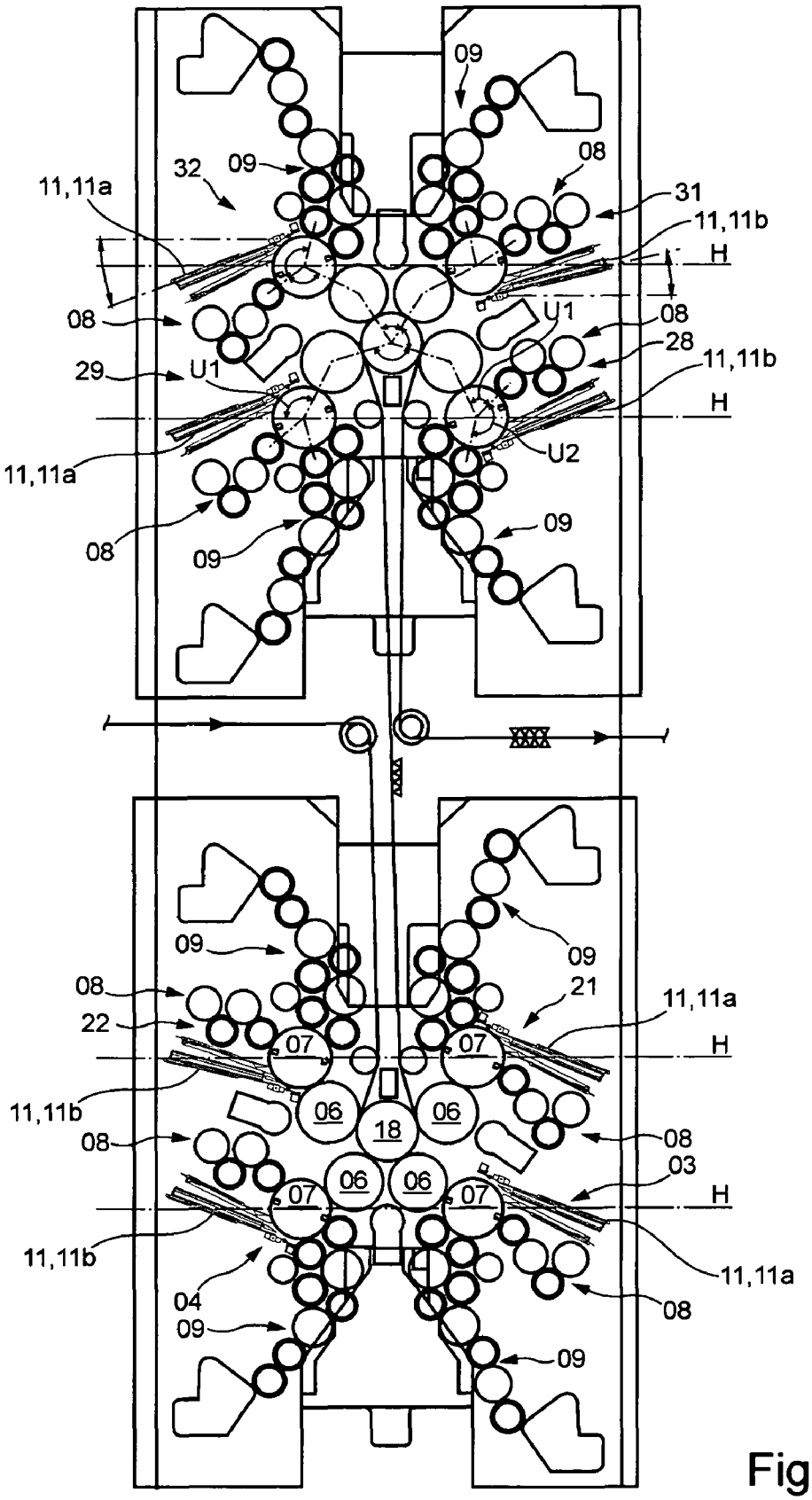

The embodiment of the present invention, which is shown in FIG. 2, generally corresponds, in its basic structure, to the embodiment of FIG. 1, so that reference is made to this basic structure here, and in what follows essentially only the differences between the two will be detailed. Equivalent or corresponding components are identified by equivalent or corresponding reference symbols in both embodiments.

In the case of the second embodiment shown in FIG. 2, the position of the dampening units 08, in particular is somewhat different from those of FIG. 1. In the embodiment of FIG. 1, all of the dampening units 08 extend approximately radially in relation to the satellite cylinder 18 and are situated almost immediately adjacent to the corresponding inking units 09. In the embodiment of FIG. 2, the dampening units 08 of printing groups 04; 21; 28; 32 extend, or are approximately perpendicular to such a radial direction. In other words, these dampening units 08 are offset by 900 relative to the embodiment of FIG. 1 in a direction opposite to the direction of rotation of the respective plate cylinder 07 on its periphery. In this manner, space is provided on the periphery of the respective plate cylinder 07, thus allowing a plate changing device 11 to be positioned between inking unit 09 and dampening unit 08 for these plate cylinders 07.

The plate changing devices 11 are arranged on the respective plate cylinders 07 in such a way that they always form an acute angle with the incoming cylinder surface of the respective plate cylinder 07. The positioning is essential to a proper functioning of the plate changing device 11, as will become clear in the context of later described embodiments. In terms of construction, this acute angle formation means that some of the plate changing devices 11 cooperate with the respectively corresponding plate cylinder 07 from above. Others of the plate changing devices 11 cooperate with the respectively corresponding plate cylinder from below.

Differentiation can therefore be made between plate changing devices 11*a* that feed in and/or out from above, as seen in the top left of FIG. 2, and plate changing devices 11*b* that feed in and/or out from below, as seen in the top right of FIG. 2. In the case of the second embodiment, that is shown in FIG. 2, the plate changing devices 11 assigned to the printing groups 03; 21; 29; 32 are plate changing devices 11*a* that feed in and/or out from above. The plate changing devices 11 assigned to printing groups 04; 22; 28; 31 are plate changing devices 11*b* that feed in and/or out from below.

The basic structure of a preferred embodiment of a plate changing devices 11 will now be described. This description will be presented within the context of the structure and the mode of operation of an example of a plate changing device 11*a* that feeds in and/or out from above. In this connection, express reference will be made to WO 2004/085160 A1, cited at the start of the subject application, and to its content, which describes a corresponding plate changing device 11*a* using a number of preferred embodiments.

Figure 3:
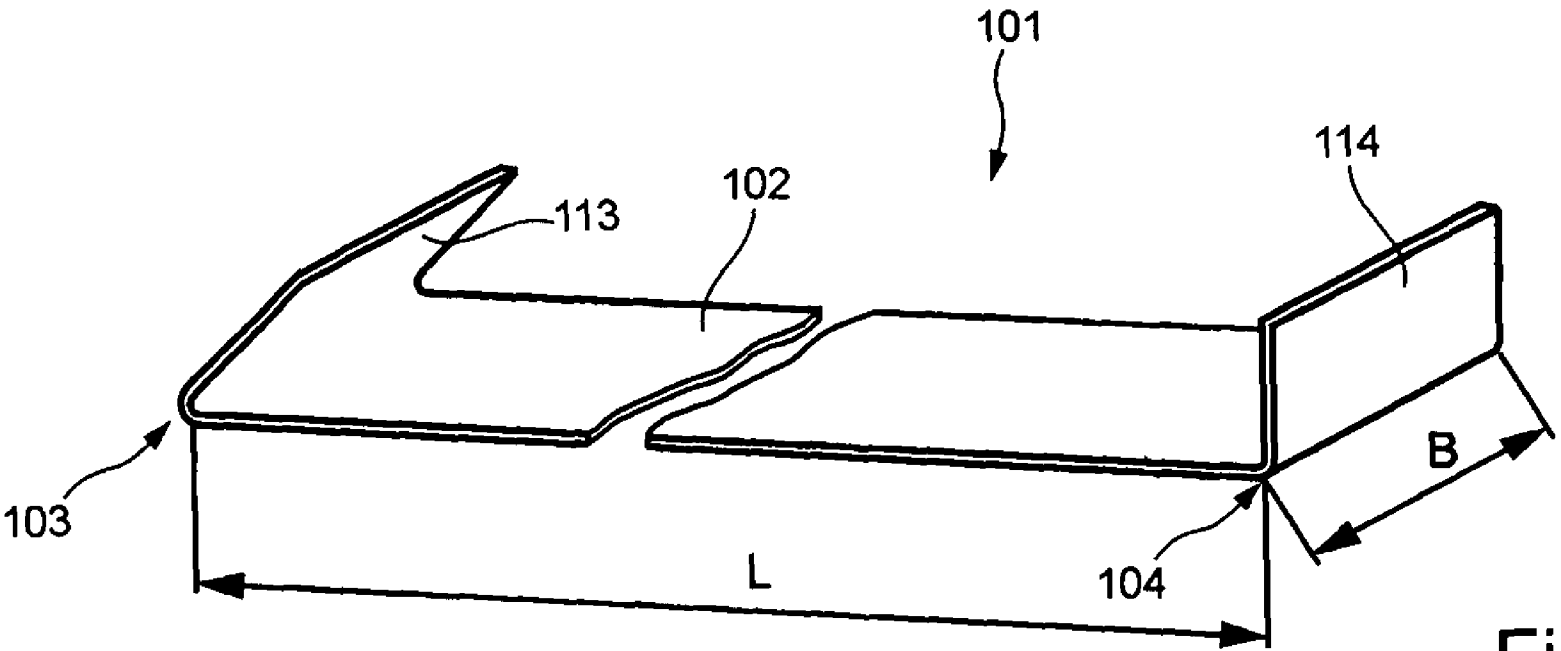

FIG. 3 shows a preferred embodiment of a plate-shaped printing forme 101 which is preferably made of springy, flexible metal. It can have a length L of, for example, between 400 mm and 1300 mm and a width B of between 280 mm and 1500 mm. When mounted on a plate cylinder, the printing plate 101 lies with a plate bearing surface 102 on the circumferential surface of a plate cylinder 07. The printing plate 101 has two opposite ends 103; 104 with angled suspension legs 113; 114. A leading suspension leg 113 is angled at an acute angle, for example, and the trailing suspension leg 114 is angled at a right angle, for example.

The printing plates 101 are preferably the size of one vertical newspaper page printed in broadsheet format and/or two horizontal newspaper pages printed in tabloid configuration.

Figure 4:
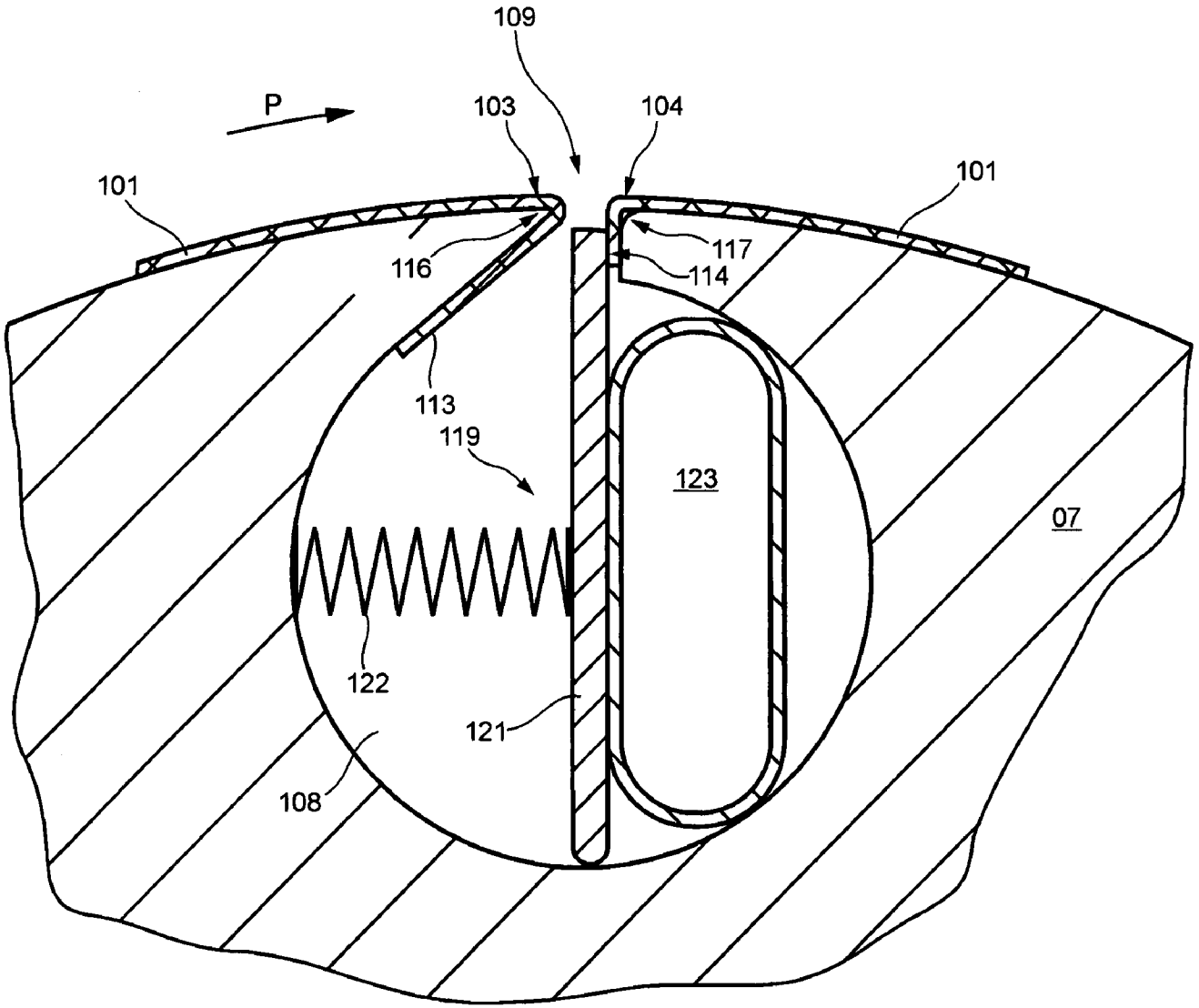

As is shown in FIG. 4, the suspension legs 113, 114 of the printing plate 101 are fastened to the respective plate cylinder 07 by the use of a holding device. That holding device is located in a groove 108, which extends generally in the axial direction, with respect to the plate cylinder 07. The end 103 of the printing plate 101 that is aligned with, or that is first with respect to the production direction P of the plate cylinder 07 is called its leading end 103, while the opposite end 104 is called the trailing end 104 of the printing plate 101.

The suspension legs 113; 114 can each be inserted into a narrow, and especially into a slit-shaped, opening 109 in the groove 108 of the cylinder 07. They can each be fastened by the use of a holding device, such as, for example, a clamping device.

The acutely angled, leading suspension leg 113 on the leading end 103 of the printing plate 101 can be suspended in a positive connection at a front edge 116 of the opening 109. The trailing end suspension leg 114, which is angled at a right angle on the trailing end 104 of the printing plate 101, can be suspended in a positive connection at a rear edge 117 of the opening 109.

At least one pivotably seated holding element 121 and one pre-tensioned spring element 122, for example, are arranged in the groove 108. The spring element 122 presses the holding element 121, for example, against the angled suspension leg 114 on the trailing end plate 104, which trailing plate end 104 is suspended from the rear edge 117 of the opening 109. The suspension leg 114 on the trailing end 104 is thus held in place against the wall that extends from the rear edge 117 to the groove 108. To release the pressure force exerted by the holding element 121, an actuating element 123, and preferably a pneumatically actuable element 123, is provided in the groove 108, which actuating element 123, when actuated, pivots the holding element 121 against the force of the spring element 122. The holding device, which is described by way of example, therefore generally comprises the holding element 121, the spring element 122 and the actuating element 123.

Figure 5:
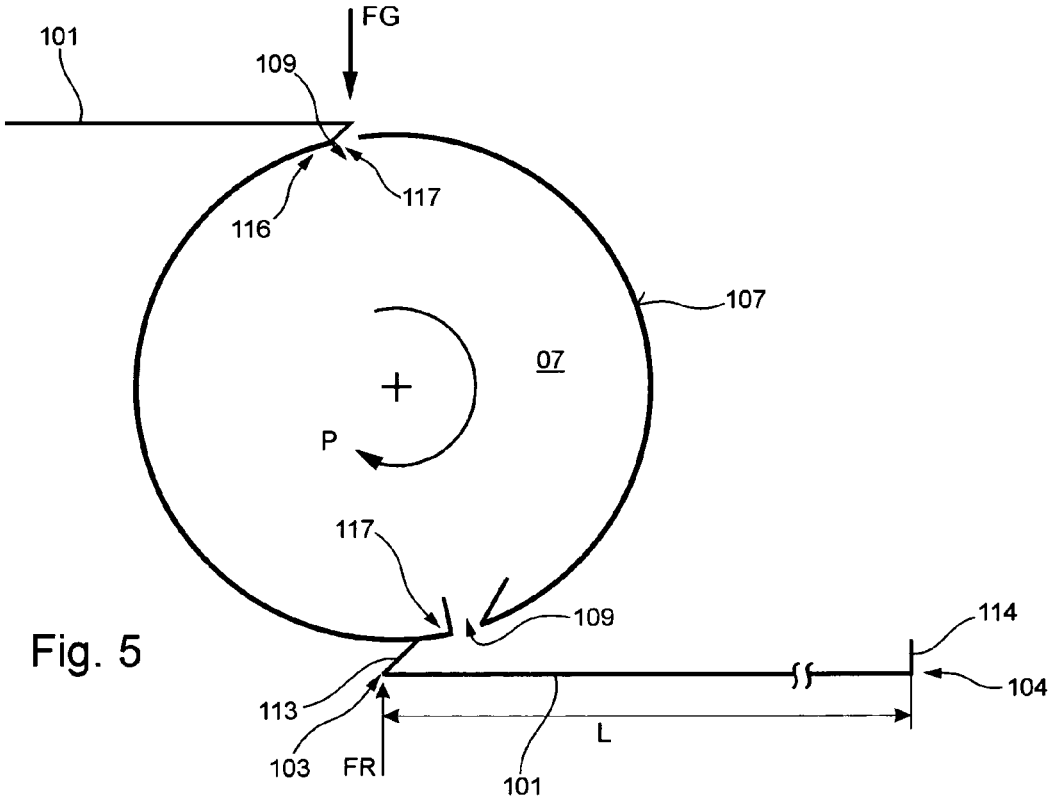

A method of mounting a printing plate 101 on a plate cylinder 07 of the printing press will now be described, with reference to FIGS. 5 and 6. Two printing plates 101 can be arranged, one in front of another, along a circumference of the plate cylinder 07. The leading end 103 of the printing plate 101 is fed to the cylinder 07, preferably tangentially with respect to the cylinder's production direction P by virtue of a thrusting force acting on the plate trailing end 104, until the suspension leg 113 on the plate leading end 103 is located beyond the second edge 117 of the opening 109 on the plate cylinder 07. In the course of a further rotation of the plate cylinder 07, in its production direction P, the suspension leg 113, which is formed on the plate leading end 103, engages in the opening 109 as a result of a radial force FR, which acts on at least the leading end 103 and which is directed toward the plate cylinder 07. The suspension leg thus becomes hooked on the first edge 116 of the opening 109. In the case in which the suspension leg 113 of the printing plate 101, formed on its leading end 103, is supported against the circumferential surface 107 of the plate cylinder 07, the radial force FR can, for example, be the gravitational force FG of the printing plate 101 acting downwardly on the circumferential surface 107 of the plate cylinder 07.

Figure 6:
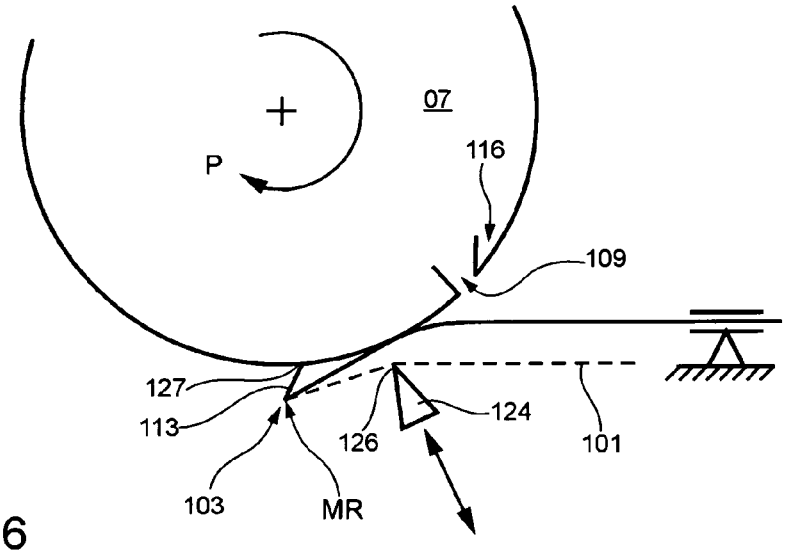

In addition to using the gravitational force FG of the printing plate 101, or as an alternative thereto, the plate leading end 103 can be elastically pre-stressed, as depicted in FIG. 6, so that the suspension leg 113 formed on the plate leading end 103 springs into the opening 109 as a result of a restoring moment MR which is directed toward the plate cylinder 07. This will occur as soon as the opening 109 of the plate cylinder 07 and the contact line 127 of the suspension leg 113 with the circumferential surface 107 of the plate cylinder 07 are directly opposite one another as a result of a relative movement between the printing plate 101 and the plate cylinder 07, with that relative movement occurring primarily by virtue of the rotation of the plate cylinder 07 in production direction P. This alternative procedure is particularly relevant in the case of printing plates that are fed in from below.

The restoring moment MR results from the fact that the printing plate 101 is made of an elastically deformable material, and therefore inherently possesses an elastically resilient property. This property is utilized in such a way that, in the course of its being brought to the plate cylinder 07, the plate leading end 103 is guided, for example, over an edge 126 of a support element 124, which support element 124 preferably extends axially with respect to the plate cylinder 07 and is spaced from that plate cylinder 07. The plate being installed is angled by that support element 124 such that a bending stress builds up on that plate leading end 103 with a spring force being directed toward the plate cylinder 07, as indicated by the dashed representation of printing plate 101 in FIG. 6. The support element 124 can be configured, for example, as a rolling element 124, specifically as a roller 124, or as one or more rollers 124 which may be arranged axially side by side in relation to the plate cylinder 07, and which can be placed against the plate cylinder 07 to function as a contact pressure element 124.

As the blanket 101 or the printing plate 101 is drawn further onto the plate cylinder 07, the suspension leg 113 on the leading end 103 of the dressing 101 hooks onto the first edge 116 of the opening 109. A roller element, which may be part of support 124 and which can be placed against the printing cylinder 07, can be used to support the mounting of the dressing 101 on the printing cylinder 07, in that the roller element 124 rolls the blanket 101 onto the printing cylinder 07. On the trailing end 104 of the blanket 101, the suspension leg 114 is formed. In the course of rolling the blanket 101 onto the printing cylinder 07, that rear suspension leg 114 is pressed by the roller element 124 into the opening 109 in the cylinder 07.

Figure 7:
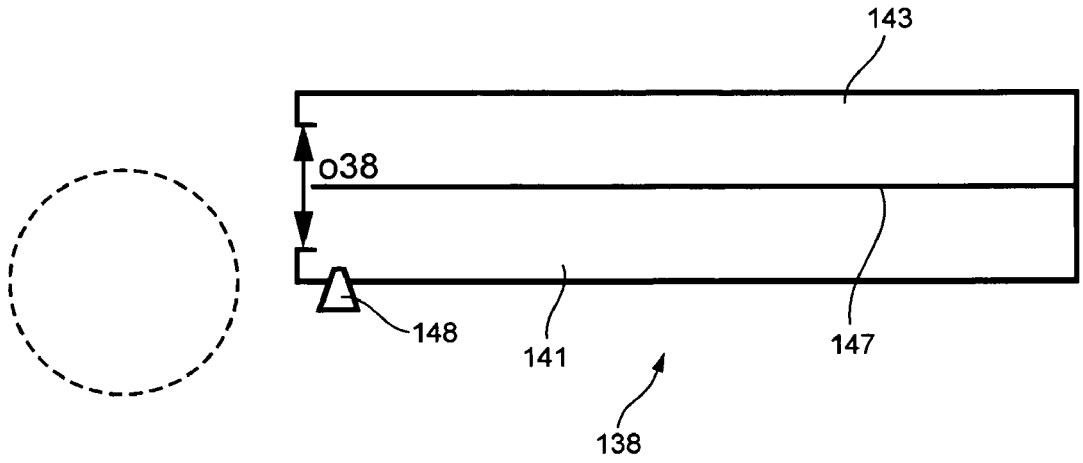
Figure 8:
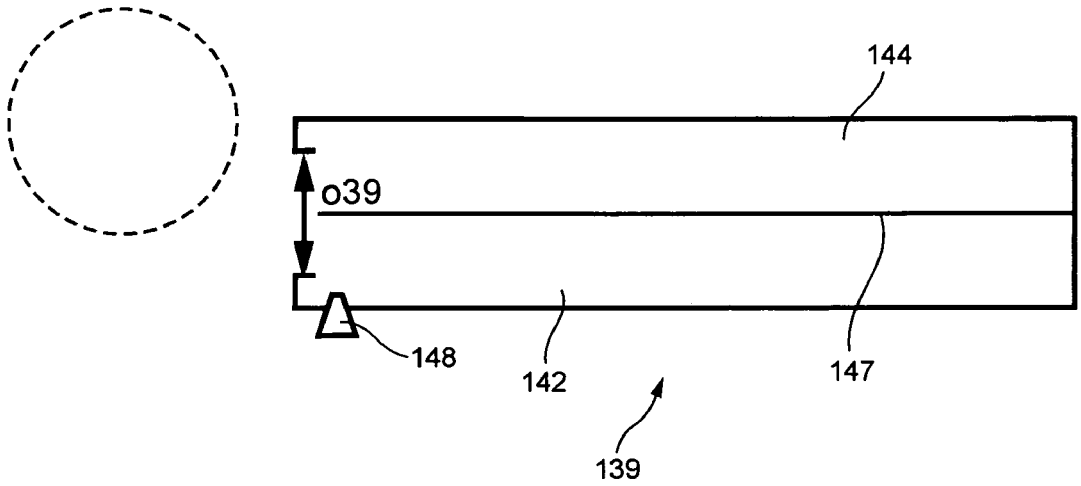

To change one or more of the printing plates 101 which are typically arranged on the respective plate cylinders 07, printing forme magazines 138 and 139 are provided, as depicted schematically in FIGS. 7 and 8. Printing forme magazine 138 is provided for a plate changing device 11*a* that feeds plates in and/or out from above. Printing forme magazine 139 is provided for a plate changing device 11*b* that feeds plates in and/or out from below. Each printing forme magazine 138; 139 has a receiving apparatus 141; 142, such as, for example, a chute 141; 142, which is configured to receive at least one used printing plate 101 to be removed from the respective plate cylinder 07, and has a receiving device 143; 144, such as, for example, a chute 143; 144, configured to receive a new printing plate 101 to be mounted on the respective plate cylinder 07. Each receiving apparatus 141; 142; 143; 144 preferably has a plurality of storage positions for used printing plates 101 that are to be removed and for new printing plates 101 that are to be mounted.

In the printing forme magazines 138; 139, the chutes 141; 143 or 142; 144 are each arranged at least essentially parallel to one another. They are preferably arranged one above another in a layered construction. A dividing wall 147 can separate the chutes 141; 143 or 142; 144 from one another in the respective printing forme magazine 138; 139. Each chute 141; 143 or 142; 144 preferably has at least two storage positions for the printing plates 101 to be stored in it.

The printing forme magazines 138; 139 each preferably extend over the length of the body of the plate cylinder 07, but extend, at least, over the width B of the printing plate 101. Each is preferably capable of fully accommodating one printing plate 101 in its entire length L, in its respective chute 141; 143 or 142; 144. In each case, one printing plate 101 can be fed to the plate cylinder 07 or from the cylinder into the chute 141; 143 through an opening o38; o39.

In the printing forme magazine 138 for a plate changing device 11*a* for feeding plates in and out from above, the chute 143 for the new printing plates 101 to be mounted is positioned above, and the chute 141 for the used printing plates 101 is positioned below, as seen in FIG. 7. In the printing forme magazine 139 for a plate changing device 11*b* for feeding plates in and out from below, the chute 144 for the used printing plates 101 is positioned above and the chute 142 for the new printing plates 101 to be mounted is positioned below it.

The printing forme magazines 138; 139 can be movably supported. The movable arrangement of the printing forme magazines 138; 139 results in improved accessibility of the printing group, such as, for example, as may be required, for performing necessary work there, such as maintenance procedures. In the operating position, preferably the chutes 141; 143 or 142; 144 of the printing forme magazines 138; 139, and at least the storage positions for the printing plates 101, are aligned horizontally or at a slight inclination, if possible, of less than 25°, and preferably of less than 15°, from the horizontal line H. The openings o38; o39 of the printing forme magazines 138; 139 advantageously points toward one of the openings 109 in the plate cylinder 07 with which the respective printing forme magazine 138; 139 cooperates.

The reference symbol 148 identifies a stop mechanism, for example a beveled bolt 148, which is configured to hold a movably mounted printing forme magazine 138; 139 in its operational position in front of the respective plate cylinder 07. When the printing forme magazine 138; 139 is in its operational position, at least one printing plate 101 can be exchanged between the chutes 141; 142; 143; 144 and the plate cylinder 07. Either a printing plate 101 that is no longer needed to perform a print job can be removed from the plate cylinder 07 and placed in the chute 141; 144, or a new printing plate 101 for performing a print job can be removed from the chute 143; 142 and mounted on the plate cylinder 07.

Figure 9:
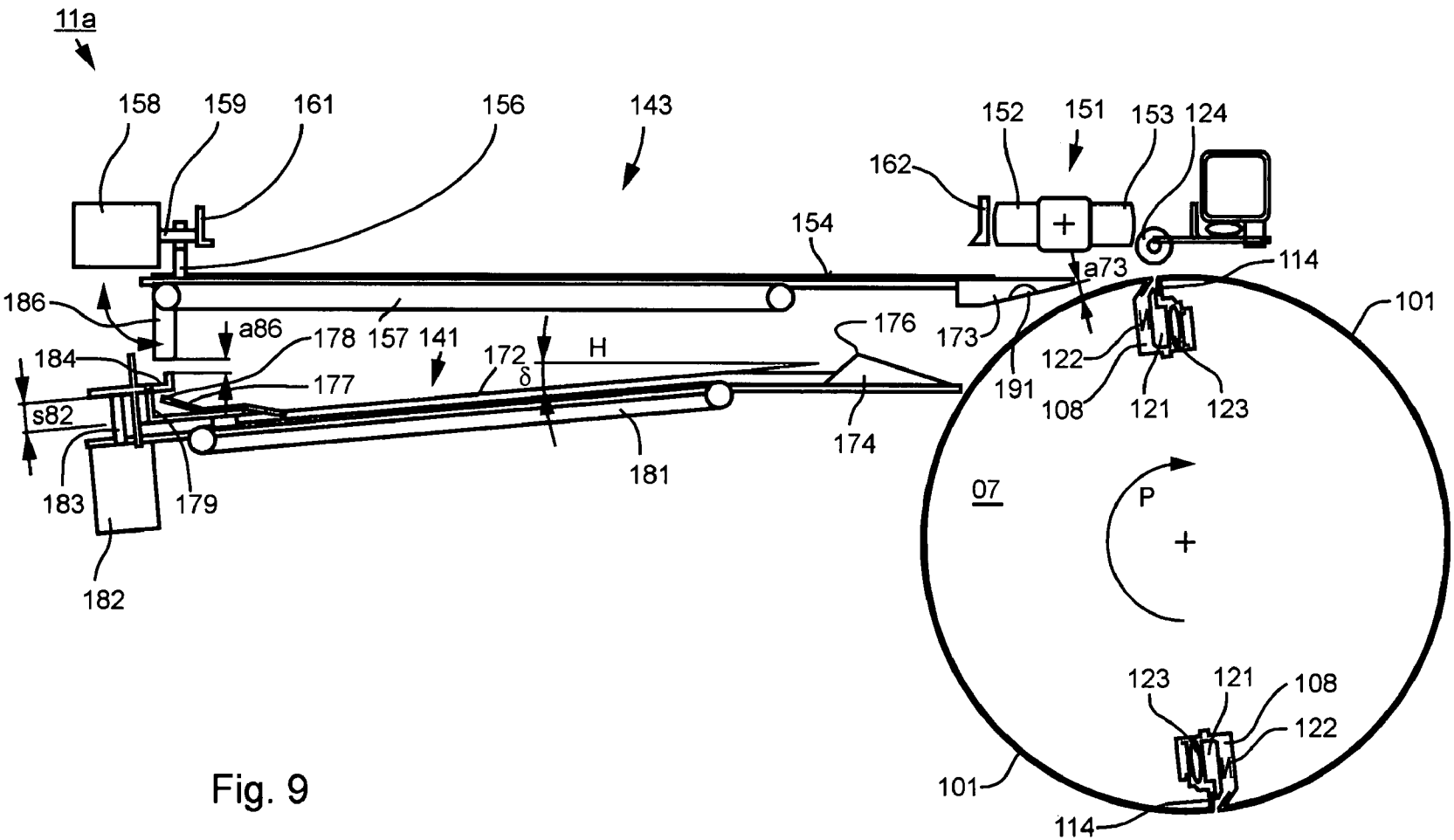

Further details of the plate changing device 11 or 11*a* will now be described with reference to FIG. 9 through 14. FIG. 9 shows a plate cylinder 07 with two grooves 108 on its periphery, offset by 180°, and with two printing plates 101 arranged one in front of another around its circumference.

FIG. 9 also shows a contact pressure element 124, now in the form of a nip roller 124 or of a pressure roller 124, which can be placed against the plate cylinder 07 by pneumatic actuation. Near the plate cylinder 07, an alignment device 151 with two diametrically opposite, wing-shaped stops 152; 153 that act laterally upon a printing plate 101 is provided. That alignment device 151 is mounted so as to pivot parallel to the axial direction of said plate cylinder. The alignment device 151 uses one of its stops 152; 153 to temporarily fix a printing plate 101, which is to be mounted, in place along the lateral register, as it is being brought to the plate cylinder 07.

A support surface 154, on which a first printing plate 101 to be mounted on the plate cylinder 07 by means of its angled suspension legs 113; 114 can be placed or laid in the chute 143. A printing plate 101 laid on the support surface 154 lies there over its entire extended length L. The suspension leg 114 on the trailing end 104 of the first printing plate 101 lies in the chute 143 against a preferably vertically oriented stop 156 on the side or end of the chute that faces away from the printing cylinder 07. The stop 156 can be moved linearly and parallel to the support surface 154 in the direction of the opening o38 of the printing forme magazine 138 by a conveyor mechanism 157. This movement is used to convey this first printing plate 101, in translational movement and preferably without deformation, far enough out of the chute 143 for the suspension leg 113 on the leading end 103 of this first printing plate 101 to engage in the slit-shaped opening 109 in the printing cylinder 07. The stop 156 in the chute 143 therefore serves as the mounting position for the first printing plate 101, and at the same time fulfills the function of a slide element 156. If this first printing plate 101 has at least one register notch on the suspension leg 114 on its trailing end 104, the stop 156 can also be advantageously configured as a register pin 156, which extends perpendicular to the support surface 154 and is connected to the conveyor mechanism 157. Thus, when the first printing plate 101 is placed against the stop 156, a pre-registration with respect to its lateral register occurs. The conveyor mechanism 157 is configured, for example, as a belt drive 157 or as a linear drive 157, and preferably is provided as a pneumatic linear drive 157, especially as a double-sided linear drive 157 without a piston rod.

Figure 10:
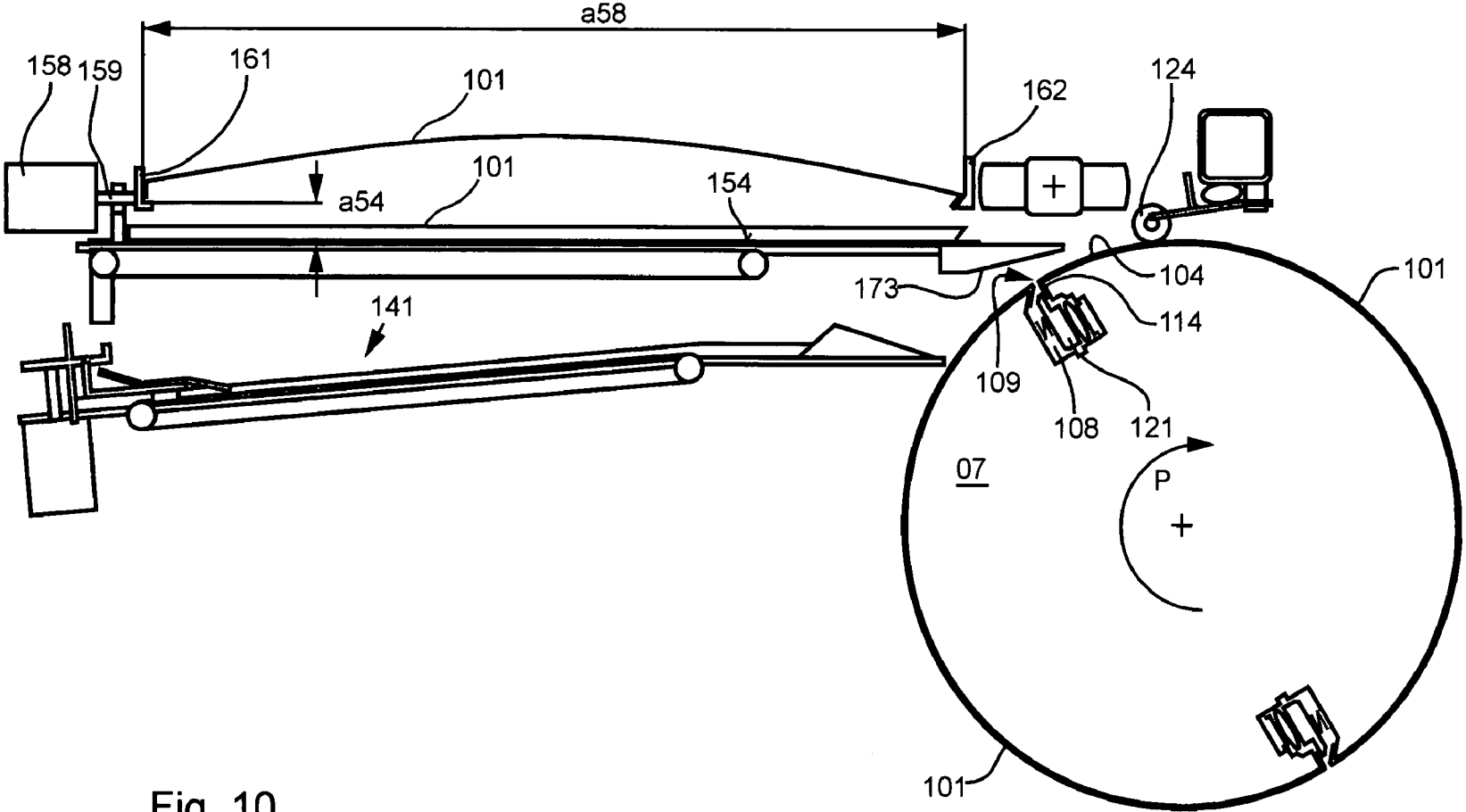

Located in the chute 143 is a holding device 158, especially a printing forme holder 158, for use in holding at least a second printing plate 101 to be mounted on the printing cylinder 07. As is shown in FIG. 10, the second printing plate 101 is held above the support surface 154 by the printing forme holder 158. This is accomplished by virtue of the fact that the printing forme holder 158 has a piston 159 or slide element 159, which can be moved parallel to the support surface 154, for example on the side of the support surface 154 that faces away from the printing cylinder 07. Slide element 159 is provided with a holding element 161, such as, for example, an L-shaped bracket 161 which is attached at its end. The second printing plate 101 is clamped above the support surface 154, between the bracket 161 on the extended slide element 159, and another holding element 162, such as, for example, a rigidly disposed stop 162, which is located in the area of the opening o38 of the printing forme magazine 138. In this configuration, a distance a54, as seen in FIG. 10, has a value that is preferably two to four times the length of the suspension leg 114 on the trailing end 104 of the second printing plate 101.

The second printing plate 101 is clamped in such a way that an inside distance a58, as is also depicted in FIG. 10, between the bracket 161 of the extended slide element 159 and the stop 162 is adjusted somewhat shorter than the extended length L of the second printing plate 101.

The stop 162, which is located in the area of the opening o38 of the printing forme magazine 138, preferably has a beveled area 163, against which the suspension leg 113 on the leading end 103 of the second printing plate 101 can be supported. The beveled area 163 of the stop 162, and the L-shaped bracket 161, against which the suspension leg 114 on the trailing end 104 of the second printing plate 101 is supported, face one another. Because the second printing plate 101 is flexible, especially along its length L, it curves when it is clamped between the bracket 161 and the stop 162. The slide element 159 of the printing forme holder 158 is preferably linearly movable parallel to the support surface 154, and preferably has two stable operating positions, a first stable operating position in its retracted mode, in which the second printing plate 101 is released, and a second stable operating position in its extended mode wherein the second printing plate 101 is clamped.

In FIG. 9 another, second chute 141 is shown, and which serves to hold printing plates 101 that have been removed from the printing cylinder 07. This second chute 141 has a support surface 172 which is preferably inclined and, which, like the support surface 154 in the chute 143, is preferably configured, not as a full surface, but in the form of parallel strips 172 or sliding rails 172, to supply printing plates 101 to be mounted on the printing cylinder 07. In the example shown in FIG. 9, the second chute 141, for use in receiving printing plates 101 that have been removed from the printing cylinder 07, is situated below the chute 143 for providing printing plates 101 to be mounted on the printing cylinder 07. This is a preferred, though not compulsory, configuration.

One preferred embodiment of the second chute 141 provides that at least two printing plates 101 can be stored in the chute 141, side by side in the axial direction of the printing cylinder 07. This embodiment enables a particularly rapid removal of printing plates 101, especially when at least two printing plates 101 can be positioned axially along the printing cylinder 07. This is because a plurality of printing plates 101 can be removed from the printing cylinder 07 at the same time.

On the side of the second chute 141, that faces the printing cylinder 07, the chute 141 for receiving printing plates 101 that have been removed from the printing cylinder 07, has, or cooperates with, at least when it is in its operating position against the printing cylinder 07, a guide element 173, which is situated near the circumferential surface 107 of the printing cylinder 07 and which is configured, for example, as a baffle plate 173, a wedge 173, or a roller element 173, such as a roller 173, which guide element 173 has the task of guiding the trailing end 104 of a printing plate 101 to be removed from the printing cylinder 07 into the chute 141. A spacing distance a73, of the guide element 173 from the circumferential surface 107 of the printing cylinder 07, is preferably not much greater than the length of the angled suspension leg 114 on the trailing end 104 of the printing plate 101. A sensor 191 can be attached to the guide element 173, which sensor 191 checks, either through contact with the printing plate 101 to be removed from the printing cylinder 07 or advantageously in a contactless fashion, such as, for example, inductively, whether the suspension leg 114 on the trailing end 104 of the printing plate 101 to be removed from the printing cylinder 07 has actually been released, following actuation of the holding element 121 that is located in the groove 108 of the printing cylinder 07.

In a preferred embodiment, after the suspension leg 114 on the trailing end 104 of the printing plate 101 to be removed from the printing cylinder 07 passes the guide element 173, it preferably arrives at a first ramp 174, which first ramp 174 is spaced somewhat from the guide element 173, before it reaches the support surface 172 in the second chute 141. In the direction of the support surface 172 of the second chute 141, the first ramp 174 first slants upward, and after a peak point 176 drops back down to the support surface 172. The first ramp 174 is preferably rigidly connected to the support surface 172. In the continuation of the introduction of the printing plate 101 to be removed from the printing cylinder 07 into the second chute 141, its trailing end suspension leg 114 arrives at a second ramp 177, the rearward edge of which preferably drops off rapidly at a steep incline to the support surface 172 after reaching its peak point 178, for example, on the side that faces away from the printing cylinder 07. In the direction in which the printing plate 101 is introduced into the chute 141, a stop 179 is positioned at a slight distance behind the peak point 178. Stop 179 is rigidly connected to the second ramp 177, and is positioned so that the suspension leg 114, on the trailing end 104 of the printing plate 101, strikes it. When the suspension leg 114 on the trailing end 104 of the printing plate 101 strikes the stop 179, it preferably engages behind the second ramp 177, in that the suspension leg 114 engages in the intermediate space formed by the aforementioned distance.

The second ramp 177 and the stop 179, which is connected to it, can be moved linearly and parallel to the support surface 172 by the provision of a conveyor mechanism 181, in order to convey the printing plate 101 to be removed from the printing cylinder 07 all the way into the chute 141. The conveyor mechanism 181, together with the steeply sloped end of the second ramp 177 for the angled suspension leg 114 on the trailing end 104 of the printing plate 101, forms a carrier system that conveys the printing plate 101 into the chute 141. This conveyor mechanism 181 is configured, for example, as a belt drive 181 or as a linear drive 181, and preferably is configured as a pneumatic linear drive 181, and especially as a double-sided linear drive 181 without a piston rod.

A lifter 182, especially a printing forme lifter 182, is positioned in the side of the chute 141 that faces away from the printing cylinder 07. The printing forme lifter 182 has, for example, a piston 183, which is preferably movable perpendicular to the support surface 172 of the chute 141, and is configured with a lifting arm 184, which is, for example, L-shaped, and especially is U-shaped, in configuration. The lifting arm 184 is arranged at the end of piston 183, wherein the angled suspension leg 114, on the trailing end 104 of the printing plate 101, is placed on or is set around the lifting arm 184. The printing forme lifter 182 preferably has two stable operating positions, namely a first stable operating position in which the piston 183 is retracted, in which the lifting arm 184 is located below the level defined by the support surface 172, and a second stable operating position in which the piston 183 is extended, in which the lifting arm 184 raises the printing plate 101 that has been removed from the printing cylinder 07 from the support surface 172. In this movement, the printing forme lifter 182 executes a stroke s82, which is greater than the length of the angled suspension leg 114 on the trailing end 104 of the printing plate 101. The value or the length of the stroke s82 is preferably between one and two times the length of the suspension leg 114. Thus, the printing forme lifter 182 raises a printing plate 101, that has been removed from the printing cylinder 07, from a preliminary first storage position to a final second storage position.

A securing element 186, for example, in the form of a strip-shaped flap 186, is arranged above the printing forme lifter 182, and especially is situated above its lifting arm 184. That securing element is preferably capable of pivoting around a pivoting axis that extends essentially parallel to the width B of the printing plate 101, with its lower edge being spaced a distance a86 from the lifting arm 184. The distance a86 is preferably smaller than the length of the angled suspension leg 114 on the trailing end 104 of the printing plate 101. In FIG. 9, a directional arrow indicates the pivoting capability of the securing element 186. The securing element 186 prevents a printing plate 101, that has been raised by the printing forme lifter 182, from unintentionally sliding into the chute 141, or from being removed from the chute 141. Thus, an operator must first pivot the securing element 186, before the raised printing plate 101 can be removed from the chute 141.

FIG. 10 through 14 show a plurality of stages of the process sequence for the changing of printing plates 101 on a plate cylinder 07, by way of example. It is first assumed that two printing plates 101 are located in the upper chute 143, which upper chute 143 is intended for use in supplying new printing plates 101 to be mounted on the printing cylinder 07, that two printing plates 101 are mounted on the printing cylinder 07 along its circumference, and that the lower chute 141, which is intended for use in receiving printing plates 101 that have been removed from the printing cylinder 07 is empty, so that, it initially holds no printing plates 101. This is the configuration shown in FIG. 10. The printing cylinder 07 rotates the opening 109 of a groove 108, in which the suspension leg 114 on the trailing end 104 of the printing plate 101 to be removed from the printing cylinder 07 is held by a holding element 121, to a first position, which is located below the guide element 173, which is a part of the lower chute 141. The contact pressure element 124 is placed against the printing cylinder 07, all as seen in FIG. 10.

The holding element 121 is then pivoted against the force of a spring element 122, causing the suspension leg 114 on the trailing end 104 of the printing plate 101 to snap out of the opening 109 by virtue of its inherent flexible tension and to strike the guide element 173. The engaged contact pressure element 124 secures the printing plate 101 from being further released from the circumferential surface 107 of the forme cylinder.

Figure 11:
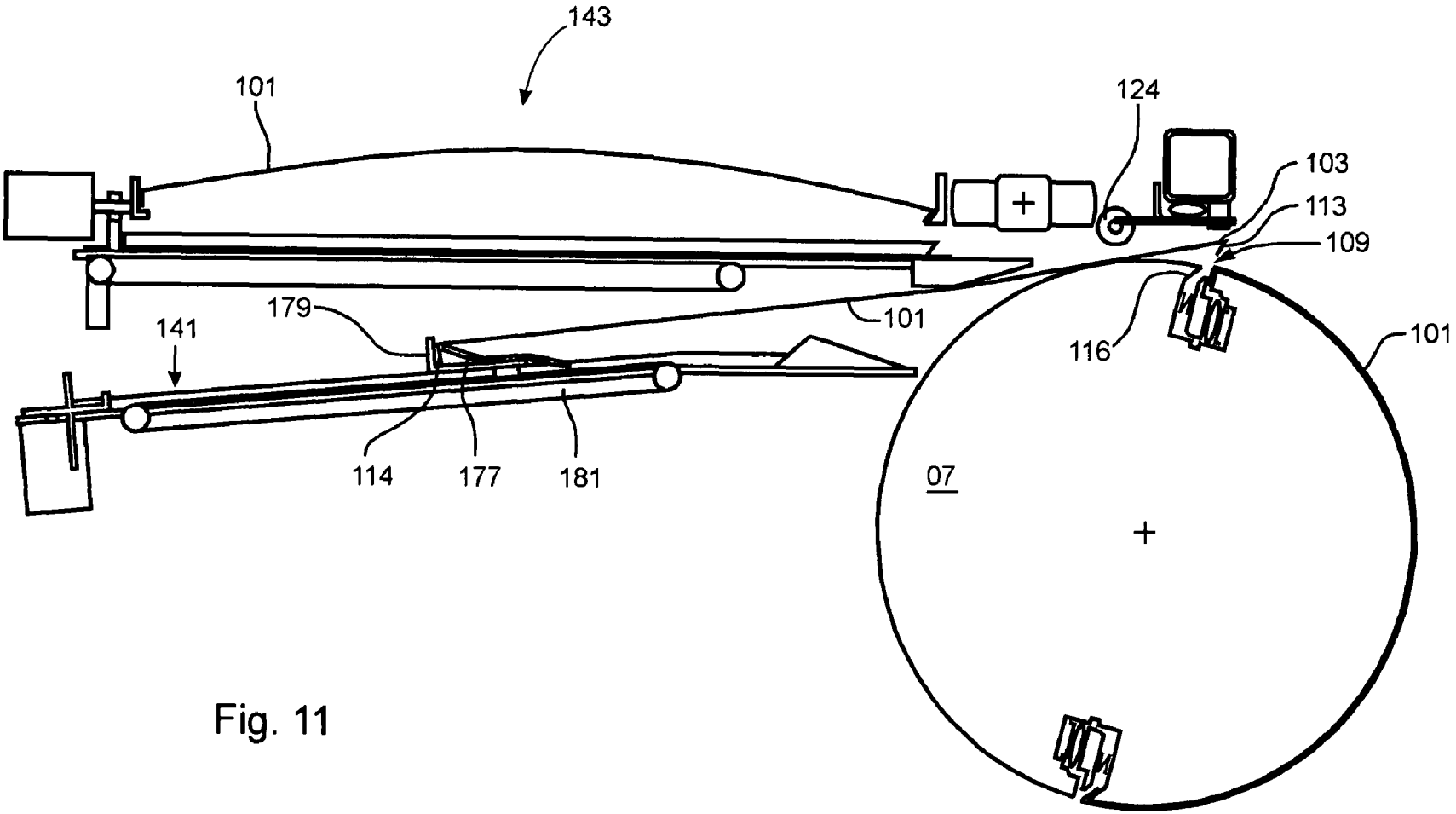
Figure 12:
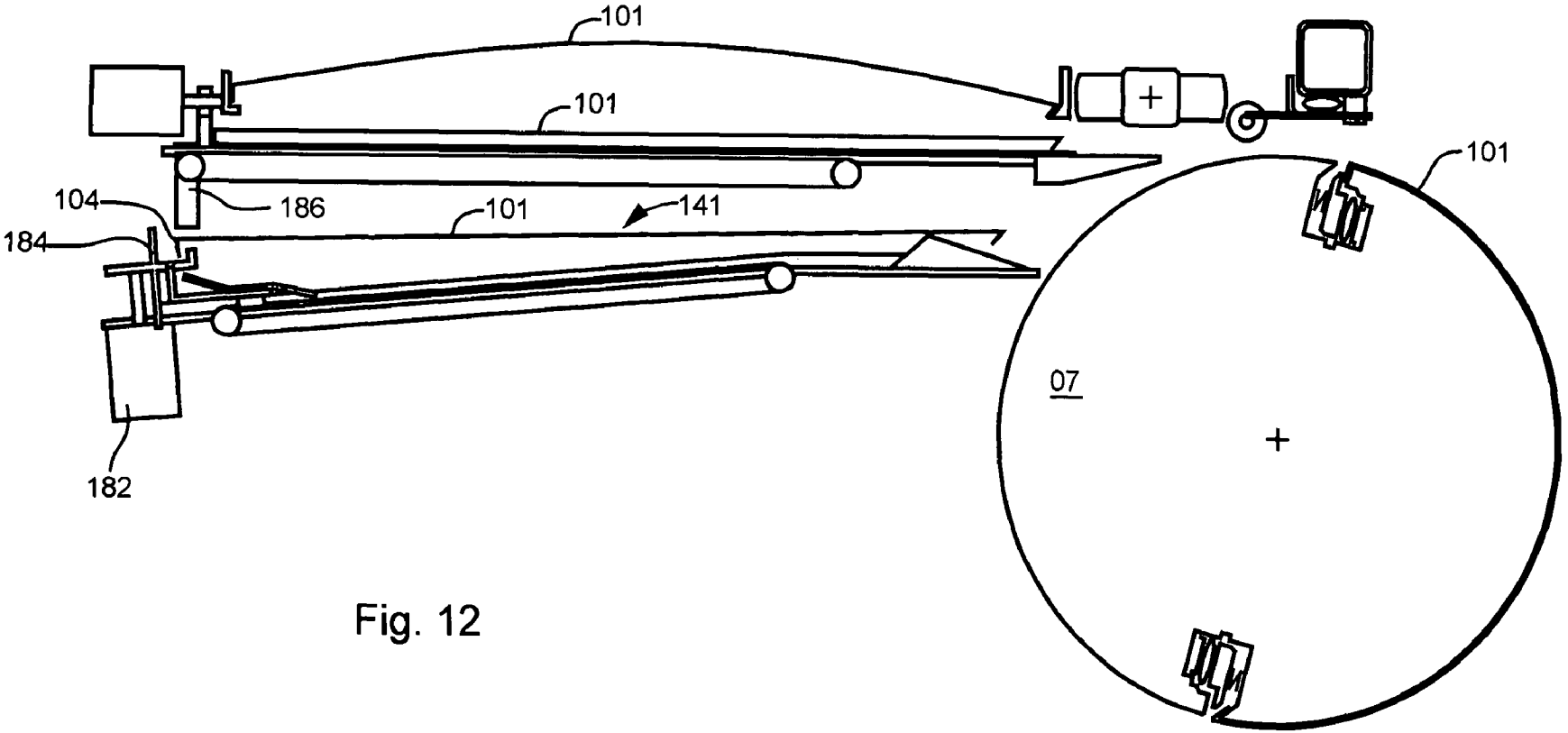
Figure 13:
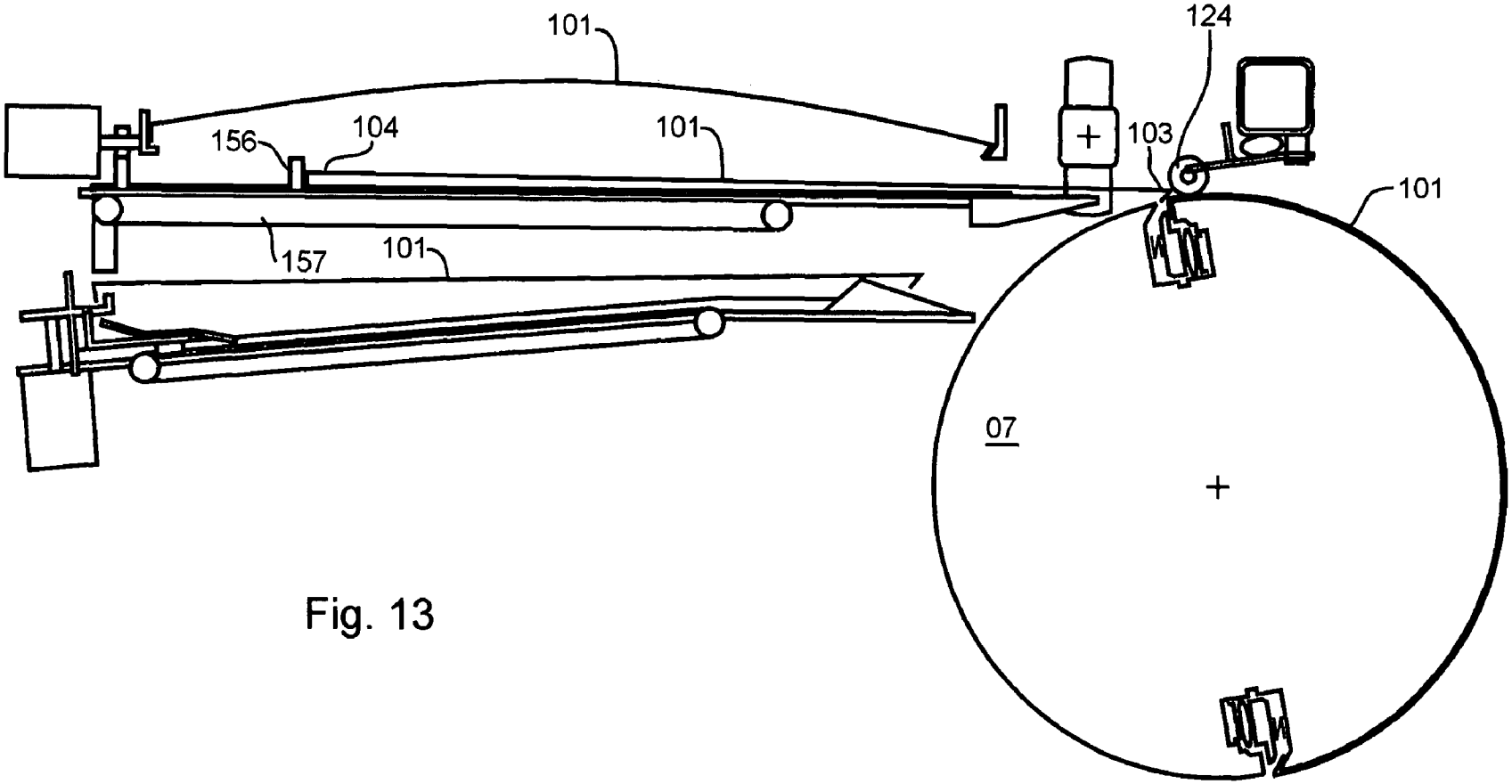

The printing cylinder 07 then rotates in the direction opposite its production direction P, thereby pushing the now released trailing end 104 of the printing plate 101 into the chute 141, as is shown in FIG. 11. During the course of the introduction of the printing plate 101 into the chute 141, the suspension leg 114 on the trailing end 104 of that printing plate 101, which is being removed, first slides along the guide element 173, and then arrives on the first ramp 174 that is a part of the chute 141. The suspension leg 114 slides upward along the ramp 174 and over its peak point 176, after which it reaches the support surface 172. While the contact pressure element 124 continues to be engaged against the printing cylinder 07, the printing plate 101 is pushed farther into the chute 142, by continuation of the rotation of the printing cylinder 07 in the direction opposite its production direction P. This continued rotation of cylinder 07 causes the suspension leg 114 on trailing end 104 of plate 101 to also reach the second ramp 177, which is connected to the conveyor mechanism 181, and to strike the stop 179 that is connected to the second ramp 177.

The contact pressure element 124 is then disengaged from the printing cylinder 07, as seen in FIG. 11. The striking of the suspension leg 114 of the trailing end 104 of the plate 101 against the stop 179 causes the angled suspension leg 113 on the leading end 103 of the printing plate 101, which leading end suspension leg 113 is suspended in a positive connection from the front edge 116 of the opening 109, to be released from the opening 109. The printing plate 101 then lies, with its leading end 103 unattached, on the circumferential surface 107 of the printing cylinder 07, as depicted in FIG. 11. From the time the suspension leg 114 on the trailing end 104 of the plate 101 was released, up to this point, the printing cylinder 07 has executed less than one half of one revolution. The angled suspension leg 114 on the trailing end 104 of plate 101 has become hooked between the second ramp 177 and the stop 179. The conveyor mechanism 181, which is connected to the second ramp 177 and the stop 179, can then draw the printing plate 101 all the way into the chute 141, as is being depicted in FIG. 11.

The printing plate 101 is then removed from the printing cylinder 07 and is located, along its length L, in the chute 141. Its suspension leg 114, on its trailing end 104, lies on the peak point 178 of the second ramp 177, while its leading end 103 lies on the peak point 176 of the first ramp 174. At least the suspension leg 113 on the leading end 103 preferably still hangs unattached, as seen in FIG. 11. Accordingly, the support of the printing forme 137 in the chute 141 preferably involves support at two points, namely at the peak points 176; 178 of the two ramps 174; 177, respectively.

The printing forme lifter 182, which can, for example, be pneumatically actuated, then raises the trailing end 104 of the printing plate 101, which has been drawn into the second chute 141, to slightly below the securing element 186. The trailing plate end suspension leg 114 is resting on the lifting arm 184 that is connected to the printing forme lifter 182, as may be seen in FIG. 12.

To now install a printing plate 101, which is to be mounted on the printing cylinder 07 in place of the now fully removed plate 101, the cylinder 07 first rotates farther, in the direction opposite to its production direction P, to a receiving position. The suspension leg 114 on the trailing end 104 of the first printing plate 101 to be mounted on the printing cylinder 07 rests at the stop 156, which stop 156 is connected to a conveyor mechanism 157. The conveyor mechanism 157 is actuated, so that the stop 156 conveys the first printing plate 101, in a movement preferably oriented tangentially in relation to the printing cylinder 07, out of the first, upper chute 143 until its leading end 103 comes into contact with the contact pressure element 124, which has now again been placed against the printing cylinder 07. The suspension leg 113, which is angled on this leading end 103, is now situated between the rear edge 117 of the opening 109 in the production direction P of the printing cylinder 07 and the contact point 188 of the contact pressure element 124 on the printing cylinder 07, as may be seen in FIG. 13.

Figure 14:
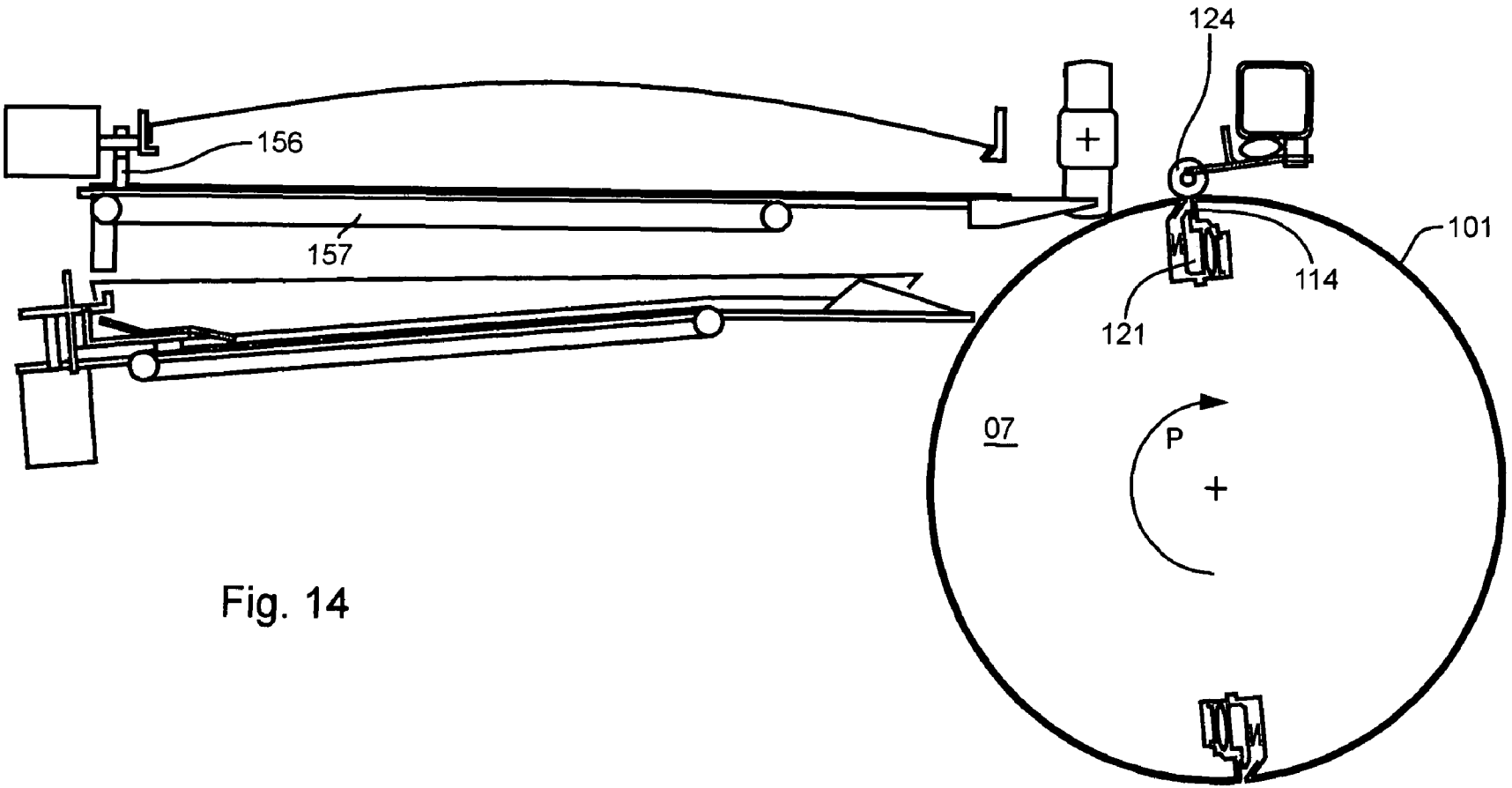

The printing cylinder 07 then changes its direction of rotation and begins to rotate in its production direction P, as seen in FIG. 14, thereby causing the suspension leg 113 on the leading end 103 of the printing plate 101, which has been placed against the printing cylinder 07, to slide into the opening 109 and to become suspended, in a positive connection, at the front edge 116 of the opening 109. By further rotating the printing cylinder 07 in its production direction P, the printing plate 101 is conveyed all the way out of the chute 143 and is drawn onto the printing cylinder 07. During such printing plate 101 mounting, the printing plate 101 is rolled on the printing cylinder 07 by the contact pressure element 124, which is placed against the printing cylinder 07. After a half revolution of the printing cylinder 07, in its production direction P, the contact pressure element 124 presses the angled suspension leg 114 on the trailing end 104 of the printing plate 101 into the opening 109. The holding element 121 in the groove 108, and belonging to this opening 109 was previously released during prior plate removal. It is now placed in the operating position in which it fixes the suspension leg 114 on the trailing end 104 of the printing plate 101, which has been inserted into the opening 109, such as, for example, by clamping it. The conveyor mechanism 157 drives the stop 156, which is connected to it, back to its original position on the side of the chute 143 that faces away from the printing cylinder 07, as may be seen in FIG. 14. The contact pressure element 124 is now removed from the printing cylinder 07, and the alignment device 151 now preferably pivots back until its diametrically opposed stops 152; 153 are in a horizontal position, as it is depicted in FIGS. 9-12.

In the operation or implementation of the above-described process steps, a change of a first printing plate 101 on the printing cylinder 07, in which a used printing plate 101 is removed and a new printing plate 101 mounted, is completed.

The changing of a second printing plate 101 is accomplished in a manner that corresponds essentially to the process specified above, and for further details, the previously cited WO 2004/085160 is expressly incorporated herein by reference.

Figure 15:
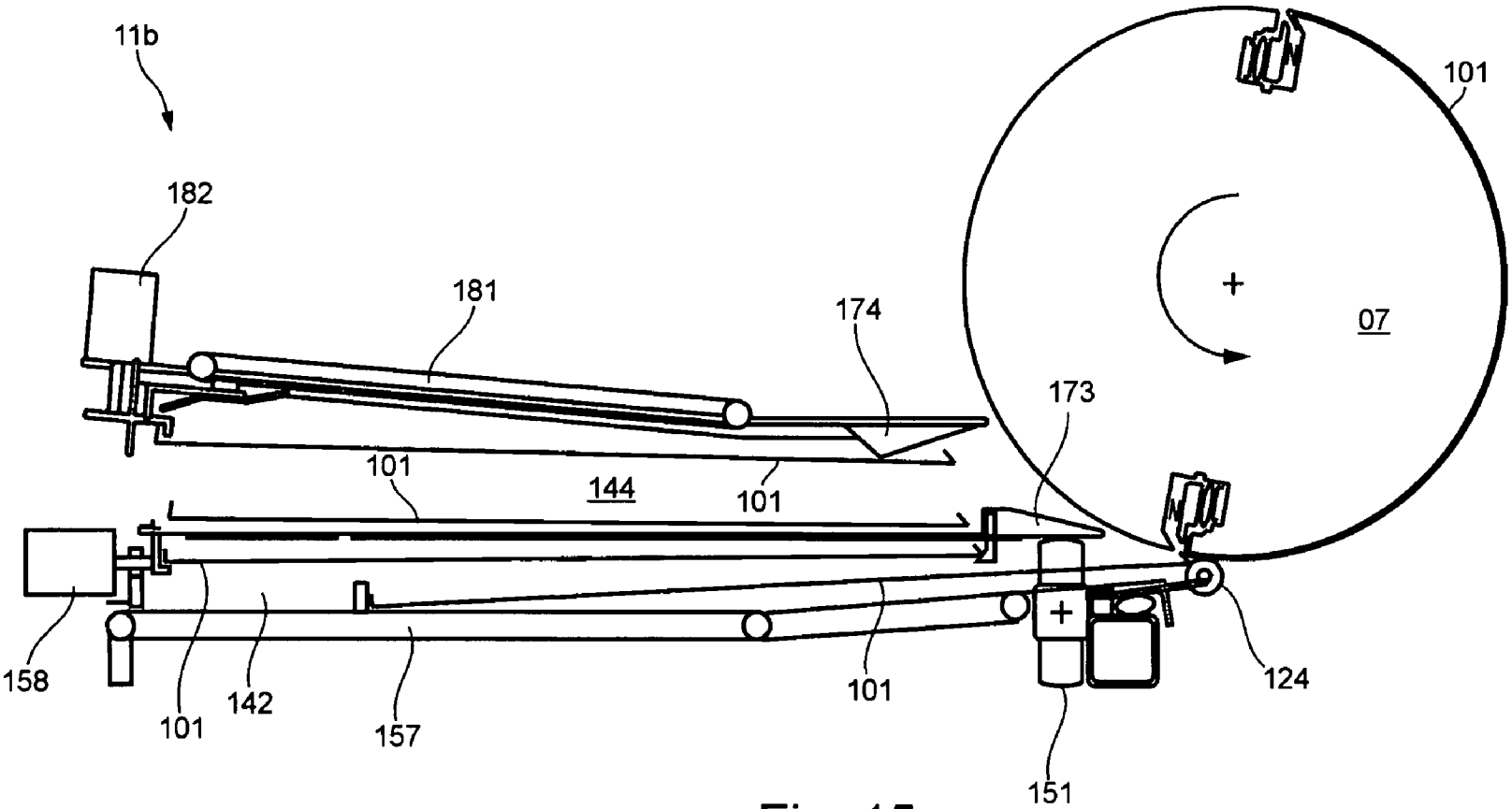

In FIG. 9 through 14, a plate changing device 11*a* was described and depicted, in which the infeed and removal of printing plates 101 occurs from above. FIG. 15 shows a plate changing device 11*b*, in which the infeed and removal of printing plates 101 to and from a plate cylinder 07 occur from below. The plate changing device 11*a* is assigned, for example, to a printing forme magazine 138, as seen in FIG. 7. The plate changing device 11*b* is assigned to a printing forme magazine 139, as seen in FIG. 8.

The structure and the functioning of the plate changing device 11*b*, in accordance with the configuration depicted in FIG. 15, correspond essentially to the structure and the functioning of the plate changing device 11*a* of FIG. 9 through 14. To this extent, reference can be made to the relevant description of the latter. The entire plate changing device 11*b* is arranged in a mirror-image configuration of the plate changing device 11*a* around a horizontal plane. In the case of the plate changing device 11*b*, in contrast to the plate changing device 11*a*, the chute 142, for use in holding the new printing plates 101 to be fed in, lies at the bottom, with the chute 144, for use in receiving the used printing plates 101, is situated above it. This also brings with it a number of structural changes in relation to the plate changing device 11*a*.

Reference will now again be made to FIG. 2. As was mentioned previously, the plate changing devices 11, which are assigned to the printing groups 03; 21; 29; 32, are plate changing devices 11*a* that feed in and out from above, and as were described in greater detail in reference to FIG. 9 through 14. The plate changing devices 11, which are assigned to the printing groups 04; 22; 28; 31 are plate changing devices 11*b* that feed in and out from below, as were described and depicted in reference to FIG. 15.

In one group of these plate changing devices 11, and namely in the plate changing devices 11*a* that feed in and out from above, the angled front ends 113 of the printing plates 101, or in other words, the suspension legs 113, therefore point downward. In the other group of plate changing devices 11, namely the plate changing devices 11*b* that feed in and out from below, the angled front ends 113 of the printing plates 101 point upward. This preferably applies to both the respective infeed chute 142; 143 and the respective removal chute 141; 144 in the two printing forme magazines, 139, 138, respectively.

Figure 16:
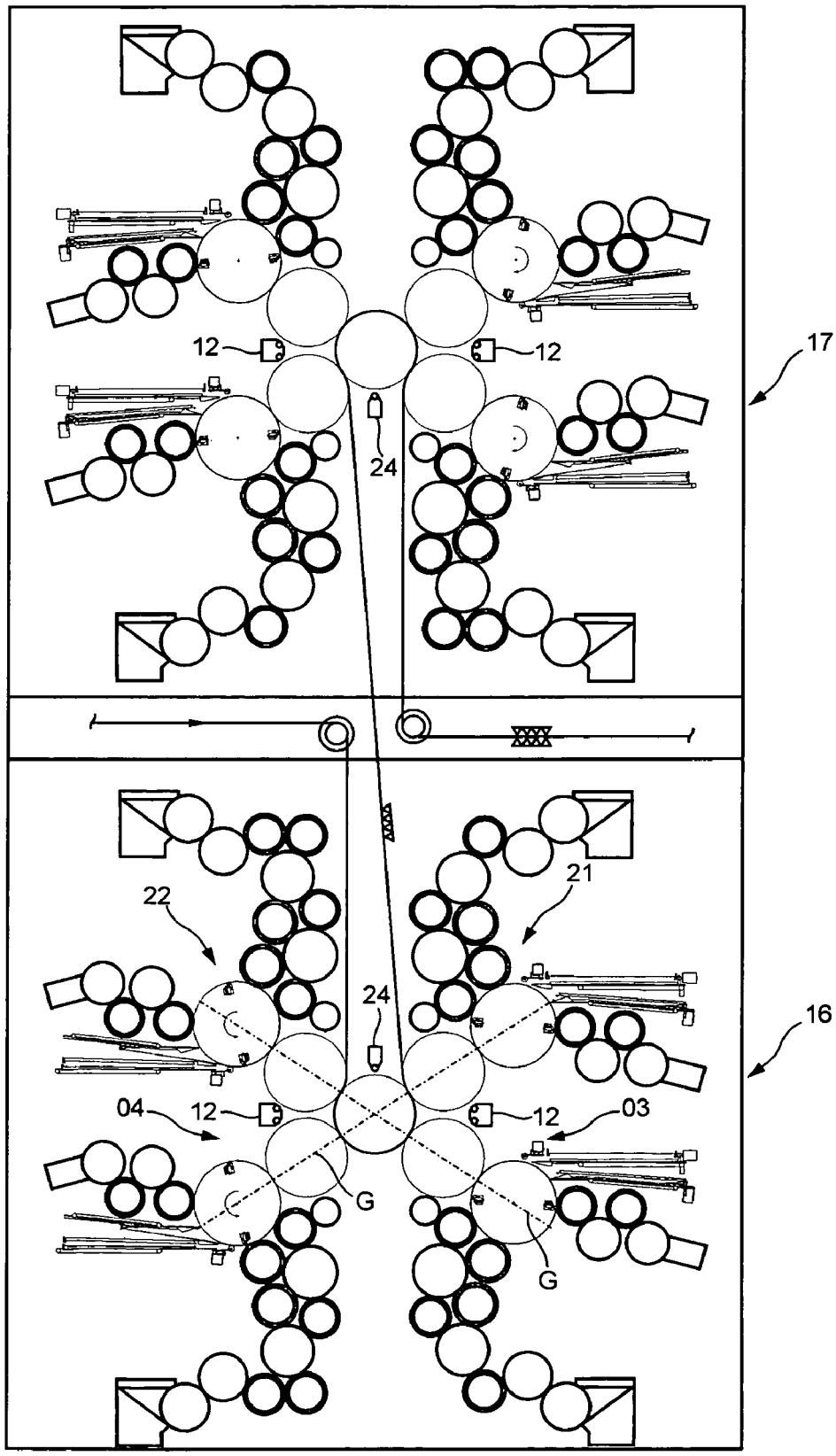
Figure 17:
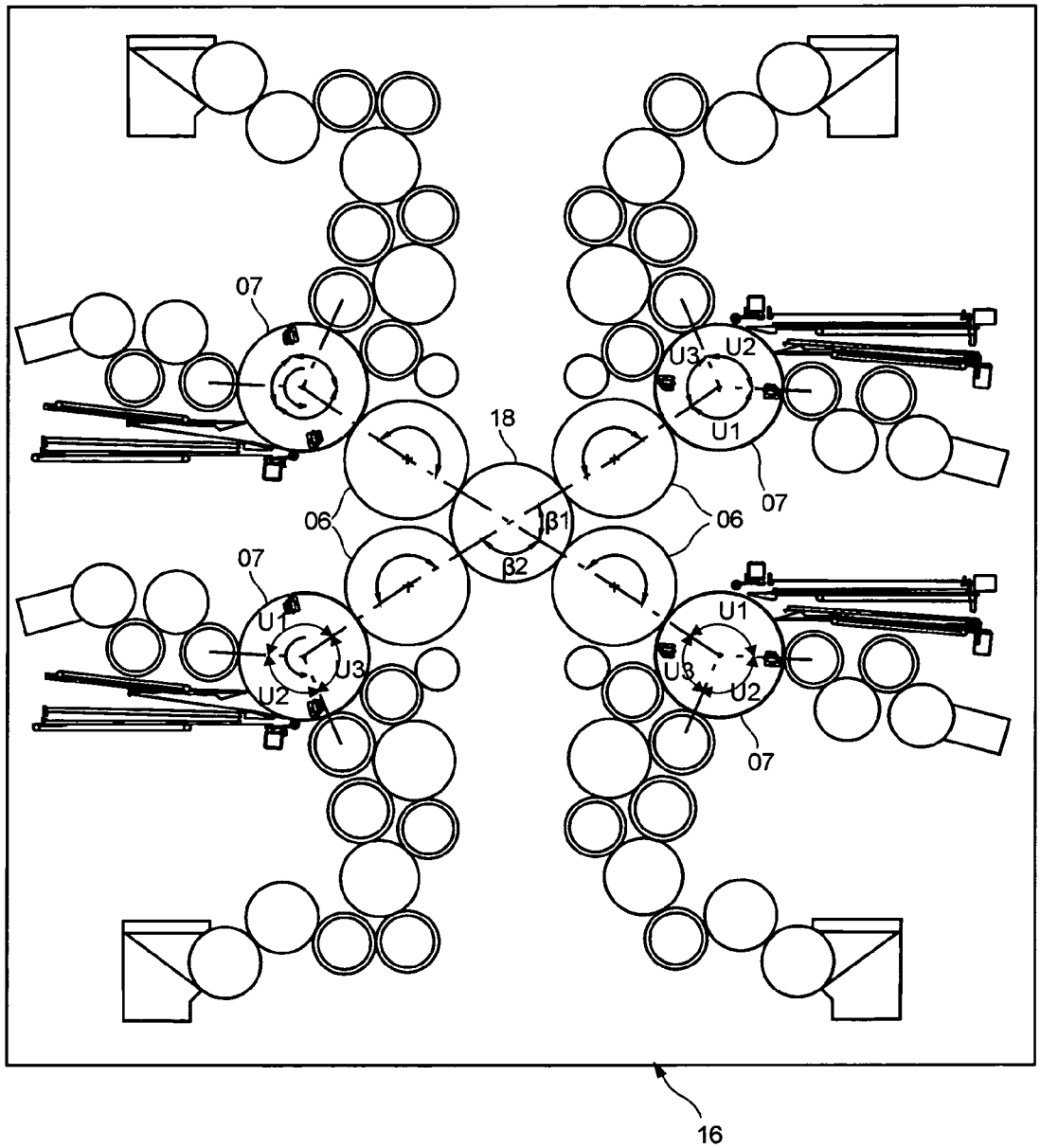
Figure 18:
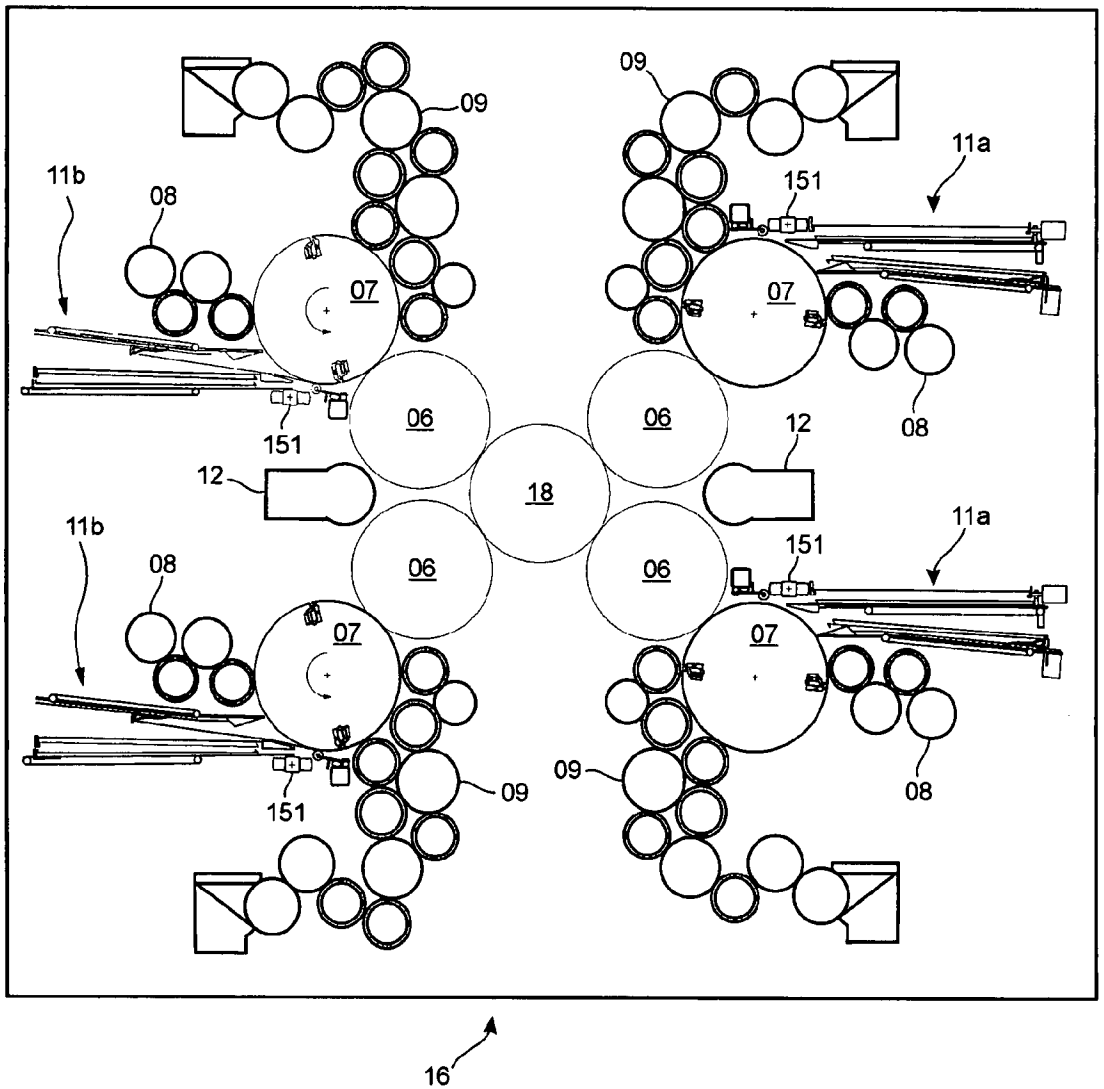

The same orientation of the respective infeed chutes and removal chutes also applies to the case of the preferred embodiments of FIGS. 16 and 17, and to that of FIG. 18. The embodiments of FIGS. 16 and 17, and that of FIG. 18, correspond, with respect to their general configuration, essentially to those of FIG. 1 and FIG. 2, so that reference will be made to these previously described and discussed configurations. Equivalent and/or corresponding components are identified by equivalent or corresponding reference symbols. The preferred embodiment of FIG. 18 corresponds essentially to that of FIG. 17. The difference is that in the case of the depiction of FIG. 18, the alignment devices 151 are also shown.

In the preferred embodiment of FIGS. 16 and 17, and in the embodiment of FIG. 18, the axes of the satellite cylinder 18, of a transfer cylinder 06, which is placed against the satellite cylinder, and of the plate cylinder 07 that cooperates with the transfer cylinder each lie at least approximately along a straight line G, as seen in dot-dash lines in the lower printing unit 16. Transfer cylinder 06 and plate cylinder 07 of printing groups, e.g., 03; 04 or 21; 22, which are positioned diametrically opposite one another on a satellite cylinder 18, lie at least approximately on a shared straight line. The plate cylinder 07 on one side, and the transfer cylinder 06 on the other, lie in pairs one above another, and especially in pairs at least essentially vertically one above another.

In the case of the preferred embodiment of FIGS. 1 and 2, the opening angle between the two transfer cylinders 06, which are situated at the bottom in the lower printing unit 16 and between the two transfer cylinders 06 situated at the top in the upper printing unit 17 is comparatively small. Therefore, these transfer cylinders 06 are arranged lying close to one another. The opening angle between the two transfer cylinders 06 that lie at the top in the lower printing unit 16 and the corresponding opening angle between the two transfer cylinders 06 that lie at the bottom in the upper printing unit 17 is comparatively large. Therefore, these transfer cylinders 06 are spaced far from one another. The configuration, in the case of the preferred embodiment of FIGS. 16 and 17 and of FIG. 18, is such that in the two printing units 16 and 17 both the two upper transfer cylinders 06 and the two lower transfer cylinders 06 are spaced far from one another. Accordingly, in each of the two printing units 16, 17, the transfer cylinders 06, which are lying above one another on a satellite cylinder 18 are arranged a short distance apart, in other words close to one another. Therefore, their respective opening angle is small.

This makes it possible, among other things, to provide a shared blanket washing device 12 for every two adjacent transfer cylinders 06, which are situated one above another, so that each nine-cylinder satellite printing unit 16; 17 requires only two blanket washing devices 12.

The arrangement of FIGS. 16, 17 and 18 can especially be such that an opening angle β1 between a straight line that connects the rotational axis of the satellite cylinder 18 to the rotational axis of a first transfer cylinder 06 and a straight line that connects the rotational axis of the satellite cylinder 18 to the rotational axis of an additional, second transfer cylinder 06 that is arranged above the first transfer cylinder 06 measures between 90° and 40°, as shown in FIG. 17. This opening angle β1 is preferably acute and can preferably lie between 75° and 55°, especially measuring approximately 65°.

Furthermore, the arrangement of FIGS. 16, 17 and 18 can be such that an opening angle β2 between a straight line that connects the rotational axis of the satellite cylinder 18 to the rotational axis of the second transfer cylinder 06 and a straight line that connects the rotational axis of the satellite cylinder 18 to the rotational axis of an additional third transfer cylinder 06 that is arranged next to the second transfer cylinder 06 is obtuse. This opening angle β2 can preferably lie between 140° and 110°, more preferably between 135° and 115°, and especially measuring approximately 125°.

The arrangement of the four transfer cylinders 06 of a nine-cylinder satellite printing unit 16 and/or 17, in accordance with FIG. 16 through 18, can be such that they define the corners of a rectangle. The vertical elevation of such a rectangle is greater than its horizontal width.

With the printing units in accordance with the invention, as specified above, preferably the following three relationships, or at least one or two of the following three relationships, apply:

In accordance with a first relationship, the two plate cylinders 07 of the printing groups 03; 04 are positioned lying side by side in what is at least an essentially horizontal direction. The one plate changing device 11 or 11*a* for the plate cylinder 07 that is assigned to the printing group 03 is situated above a horizontal line H that extends through the rotational axis of that respective plate cylinder 07. The other plate changing device 11 or 11*b* of the plate cylinder 07 that is assigned to the printing group 04 is situated below a horizontal line H that extends through the rotational axis of that plate cylinder 07. More specifically, in the case of the preferred embodiment of FIG. 2, the above-discussed relationship applies to the respective front sections of the plate changing devices 11*a*; 11*b* that face the respective plate cylinder 07.

The above relationship also applies to the plate changing devices 11*a*, 11*b* of the plate cylinders 07 of printing groups 21; 22, printing groups 29; 28 and printing groups 32; 31.

A second relationship also applies, and according to it, the two plate cylinders 07 of the printing groups 03; 04 are arranged lying side by side in an at least essentially horizontal direction. A plate changing device 11*a* or 11*b* is assigned to each of the two plate cylinders 07. Each such plate changing device 11*a*; 11*b* has an infeed plane and a removal plane, which can be defined by the respective chute 143; 142 or 141; 144 of the corresponding printing forme magazine 138; 139, as seen more specifically in FIGS. 7 and 8. In one plate changing device 11*a*, the infeed plane 143 is situated above the removal plane 141, and in the other plate changing device 11*b*, the infeed plane 142 is situated below the removal plane 144.

The second relationship above also applies to the plate changing devices 11*a*, 11*b* of the plate cylinders 07 of printing groups 21; 22, of printing groups 29; 28 and of printing groups 32; 31.

Finally, a third relationship applies. According to this third relationship, at least one ink forme roller of an inking unit 09 and at least one dampening agent roller of a dampening unit 08 are each situated so as to cooperate directly with the two plate cylinders 07 of the printing groups 03; 04. In each case, an additional cylinder 06, and especially a transfer cylinder 06 or a rubber blanket cylinder 06, is situated so as to cooperate directly with the plate cylinder 07. A plate changing device 11*a* or 11*b* is assigned to each of the two plate cylinders 07. A first circumferential section U1 of the plate cylinder 07, as shown in FIG. 17, is defined by a straight line that connects the rotational axis of the plate cylinder 07 to the rotational axis of the additional transfer cylinder 06, and by a straight line that connects the rotational axis of the plate cylinder 07 to the rotational axis of the dampening agent roller of the dampening unit 08. A second circumferential section U2 of the plate cylinder 07 is defined by a straight line that connects the rotational axis of the plate cylinder 07 to the rotational axis of the ink forme roller of the inking unit 09, and by a straight line that connects the rotational axis of the plate cylinder 07 to the rotational axis of the dampening agent roller of the dampening unit 08. A plate changing device 11*a* of the one plate cylinder 07 is situated in the first circumferential section U1, and a plate changing device 11*b* of the other plate cylinder 07 is situated in the second circumferential section U2.

The above-described third relationship also applies to the plate changing devices 11*a*, 11*b* of the plate cylinders 07 of printing groups 21; 22, printing groups 29; 28 and printing groups 32; 31.

In addition to the first circumferential section U1 and the second circumferential section U2, a third circumferential section U3 of the plate cylinder 07 is also defined, in this case by a straight line that connects the rotational axis of the plate cylinder 07 to the rotational axis of the additional cylinder 06, or in other words, to the transfer cylinder 06, and by a straight line that connects the rotational axis of the plate cylinder 07 to the rotational axis of the ink forme roller of the assigned inking unit 09, as seen in FIG. 17. It is also especially provided, in this connection, that the first circumferential section U1 and the second circumferential section U2 do not overlap, and preferably that the first circumferential section U1, the second circumferential section U2 and the third circumferential section U3 all do not overlap.

It can preferably be provided that the first circumferential section U1 and the second circumferential section U2 are situated directly adjacent to one another, and it can especially be provided that the first circumferential section U1, the second circumferential section U2 and the third circumferential section U3 are all situated directly adjacent to one another. Preferably, this configuration is such that the first circumferential section U1, the second circumferential section U2 and the third circumferential section U3 make up the entire circumference of the plate cylinder 07.

It can also be preferably provided that the opening angle of the first circumferential section U1 lies between 70° and 150°, especially between 90° and 130°, preferably between 100° and 120°, and is preferably obtuse and can especially measure approximately 110°.

It can also preferably be provided that the opening angle of the second circumferential section U2 is also obtuse, preferably lying between 110° and 190°, more particularly lies between 130° and 170°, preferably between 140° and 160°, and can especially measure approximately 150°.

Finally, it can preferably be provided that the opening angle of the third circumferential section U1 lies between 60° and 140°, more particularly lies between 80° and 120°, preferably lies between 90° and 110°, and can especially measure approximately 100°.

The contact pressure element 124, which was described in some detail above, and which can be a nip roller 124, is situated alternately in the first circumferential section U1 and in the second circumferential section U2 in adjacent plate cylinders 07, in accordance with the configuration of the associated plate changing device 11*a* or 11*b*, respectively. Furthermore, this contact pressure element 124 is situated alternately above and below the horizontal line H in adjacent plate cylinders 07, again, based upon the configuration of the associated plate changing device 11*a* or 11*b*, respectively.

As was mentioned previously, the plate changing device 11*a* or 11*b* has an infeed plane 143 or 142, which can either be horizontally aligned, or can form an angle of between 0° and 40° with the horizontal line H, and particularly an angle that is smaller than 30°. The plate changing device 11*a* or 11*b* also has a removal plane 141 or 144, which can also either be aligned horizontally or can form an angle measuring between 0° and 40° with the horizontal line H, and particularly an angle that is smaller than 30°. The infeed plane 143; 142 can form an acute angle with the removal plane 141; 144, or can be parallel to that plane.

In the case of the preferred embodiment of FIG. 1, 6/2 printing units are assumed. In other words, the depicted printing units have plate cylinders with six printing plates 101 lying side by side in an axial direction, and with two printing plates 101 lying, one in front of another, in a circumferential direction. In general, however, it is assumed that each plate cylinder 07 has at least one printing plate 101 in an axial direction, and preferably has two or three or four or five or six or eight printing plates 101 lying side by side in an axial direction. It is further generally assumed that each plate cylinder 07 has at least one printing plate 101 in a circumferential direction, and preferably has two or four printing plates 101 lying one in front of another in a circumferential direction.

Figure 19:
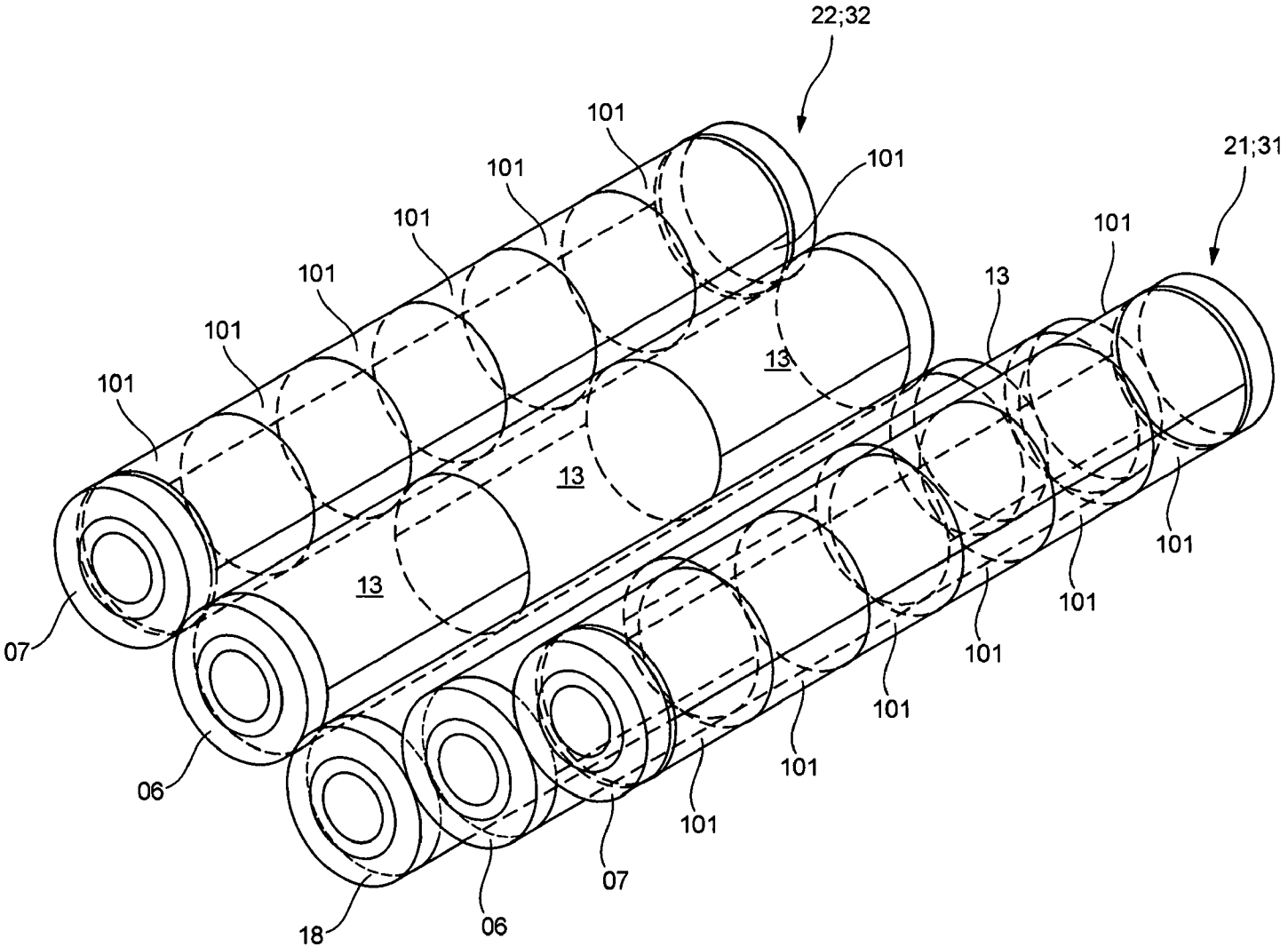

FIG. 19 shows generally a 6/2 blanket-to-blanket printing unit, and more specifically shows a perspective representation of a section of a satellite printing unit 16 or 17, such as, for example, in accordance with FIG. 16, and being comprised of the satellite or counter-pressure cylinder 18 with the two printing groups 21; 22 and 31; 32, respectively. The transfer cylinders 06 or the rubber blanket cylinders 06 are each loaded with three blankets 13, preferably rubber blankets 13, which are arranged side by side in an axial direction, each adjacent blanket is being offset from its next adjacent blanket 13 by 180°. The plate cylinders 07 are each covered with six plates 101, especially printing plates 101. These are situated side by side in an axial direction of the plate cylinder 07. In the circumferential direction of the plate cylinder, two printing plates 101 are arranged one in front of another.

Depending on the number of the plurality of printing plates 101, which are held axially on the respective plate cylinder 07, it can preferably be provided, in a manner not specifically detailed here, that a corresponding number of a plurality of printing plates 101 are arranged side by side in the plate changing device 11, as viewed axially along the plate cylinder 07. It is then expedient, in a manner which is also not specifically detailed here, for each of the printing plates 101 that are arranged side by side to be assigned at least one previously described contact pressure element 124. It is especially preferable for each such at least one contact pressure element 124, which is assigned to a respective printing plate 07, to be actuable independently of the other contact pressure elements 124, which are assigned to the other respective printing plates 101. The infeed and/or the removal for each printing plate 101 can be performed independently of such infeed and/or removal of another printing plate 101.

To accommodate a plurality of printing plates 101, which are arranged side by side in the plate changing device 11, that device can have a plurality of chute-type areas 141; 142; 143; 144 or chutes 141; 142; 143; 144. At least two chute-type areas 141; 142; 143; 144 can be arranged lying side by side. Preferably, however, the number of chute-type areas 141; 142; 143; 144, which are lying side by side, corresponds to the number of printing plates 101 that can be arranged side by side in an axial direction on the assigned plate cylinder 07.

Furthermore, particularly in the case of a plate cylinder 07 with two printing plates 101 that are arranged one in front of another in a circumferential direction on the plate cylinder 07, in each plate changing device 11, two chute-type areas 142; 144 or 143; 141 can be arranged lying one above another. In this case, one of the two chute-type areas 142; 144 or 143; 141 which are lying one above another is an infeed chute 142; 143 and the other of the two chute-type areas lying one above another 142; 144 or 143; 141 is a removal chute. The configuration is preferably such that each plate changing device 11 comprises a number of infeed chutes 142; 143 lying side by side, which number of infeed chutes 142; 143 corresponds to the number of printing plates 101 on the assigned plate cylinder 07, and a corresponding number of removal chutes 141; 144 situated above or below the infeed chutes 142; 143. The number of infeed chutes 142; 143 arranged side by side in the plate changing device 11 can preferably be four or six such chutes.

In the configuration of the plate cylinder 07 with a plurality of printing plates 101 arranged side by side on a plate cylinder 07, such as is shown in FIG. 19) a groove 108, such as the groove which is depicted in FIG. 4, or a section of a groove 108, that is intended to receive the angled front end 113 of each printing plate 101, is assigned to each printing plate 101. It is preferably provided that for printing plates 101, which are arranged side by side, a groove 108 of corresponding length is formed, which groove 108 can preferably be continuous in configuration axially along the plate cylinder 07.

Holding devices 119, for use in holding the ends 113 of the printing plates 101, are provided in the grooves, as was described in connection with FIG. 4, which holding devices 119 can especially comprise the holding elements 121, the spring elements 122 and the actuating elements 123. To be able to accomplish a plate change for each printing plate 101, independently of a plate change of another printing plate 101, particularly in the case of a plurality of printing plates 101 which are arranged side by side on a plate cylinder 07 in an axial direction, a separate holding device 119 is provided for each printing plate 101. Each such holding device 119 can be actuated independently of the other holding devices. These separate holding devices 119 are preferably pneumatically actuated.

The drive configuration for each respective nine-cylinder satellite printing unit 16 or 17 or for the printing tower 14 can be configured such that each plate cylinder 07 can be actuated independently of the other plate cylinders 07 via a position-controlled drive motor, which is not specifically shown. In this manner, a plate change can be performed on a particular plate cylinder 07 independently of a plate change being performed on another plate cylinder 07. It can also expediently be provided that each plate cylinder 07 can be driven in a positive manner, independently of its associated satellite cylinder 18, via such a separate position-controlled drive motor. With this configuration, the satellite cylinder 18 can advantageously also have its own position-controlled drive motor.

In the case of the above-described preferred embodiments, the circumference of the satellite cylinder 18 corresponds to the circumference of the plate cylinder 07 or forme cylinder 07. If the circumference of the plate cylinder 07 corresponds to one page, and especially to one newspaper page, the circumference of the satellite cylinder 18 also corresponds to one page, and also especially to one newspaper page. If the circumference of the plate cylinder 07 corresponds to two pages, and especially to two newspaper pages, the circumference of the satellite cylinder 18 also corresponds to two pages, and especially to two newspaper pages. In the case of the first alternative, the circumference of the satellite cylinder 18 is equal to the cut-off length of the plate cylinder 07, and in the case of the second alternative, it is equal to twice the cut-off length of the plate cylinder 07.

In general, the ratio of the circumference of the satellite cylinder 18 to the circumference of the plate cylinder 07 can particularly be configured such that the circumference of the satellite cylinder 18 corresponds to a whole number multiple of the cut-off length of the plate cylinder 07.

As is depicted, for example, in FIG. 19, the circumference of the plate cylinder 07 can preferably correspond to two pages, and especially to two newspaper pages. In this case, the diameter or the circumference of the satellite cylinder 18 can amount to 1.5 times, to 2 times, to 2.5 times or to 3 times, and if applicable can amount to even a corresponding higher multiple of the diameter or circumference of the plate cylinder 07. In general terms, the diameter of the satellite cylinder 18 can correspond to n-times the respective diameter of the assigned plate cylinder 07, wherein n=0.5×"a" and "a" is a natural number that is greater than or equal to 3. In general terms, the diameter of the satellite cylinder 18 can correspond to m-times the respective diameter of the assigned rubber blanket cylinder 06, wherein m=0.5×"a" and "a" is a natural number that is greater than or equal to 3.

Figure 20:
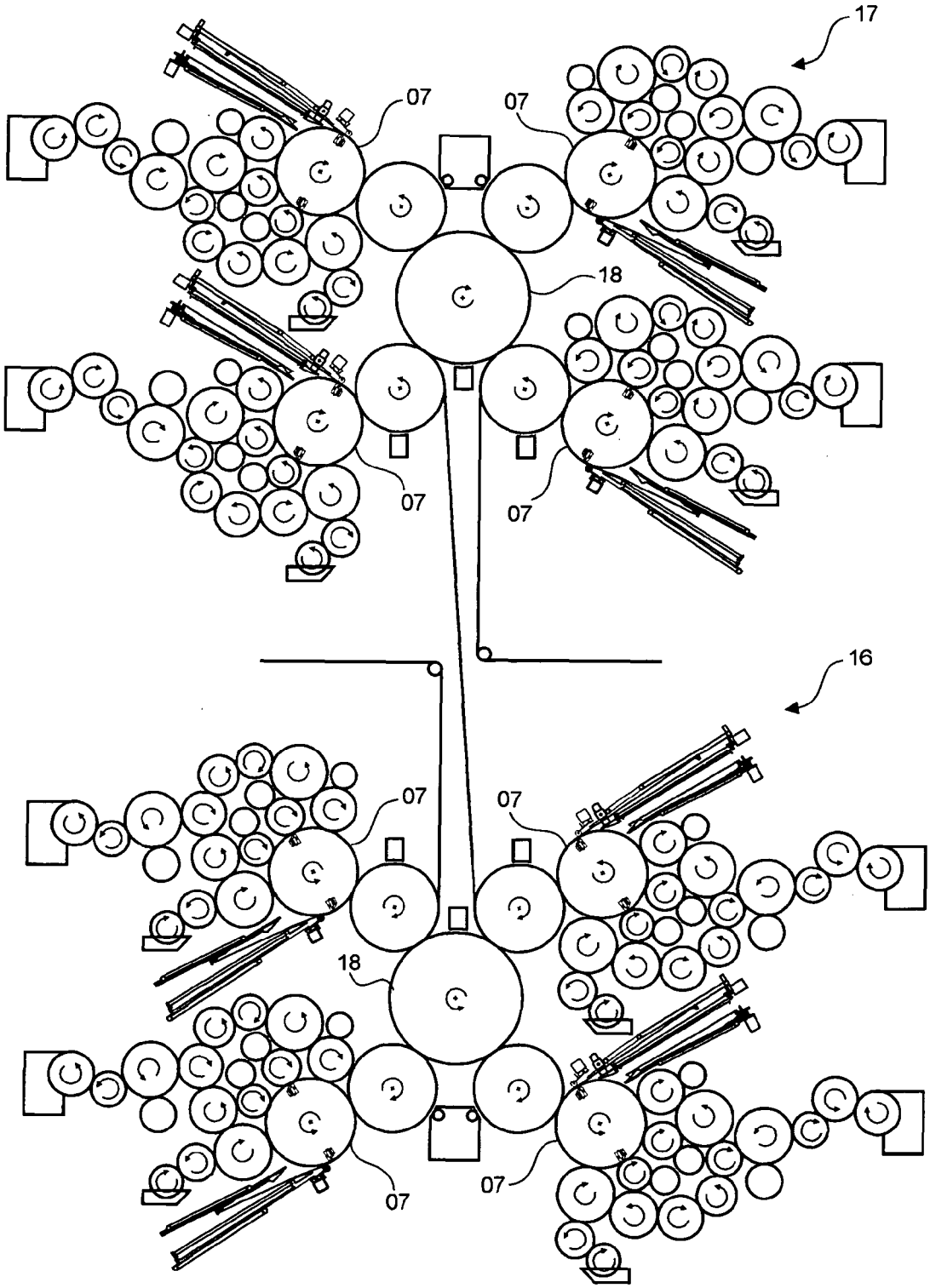
Figure 21:
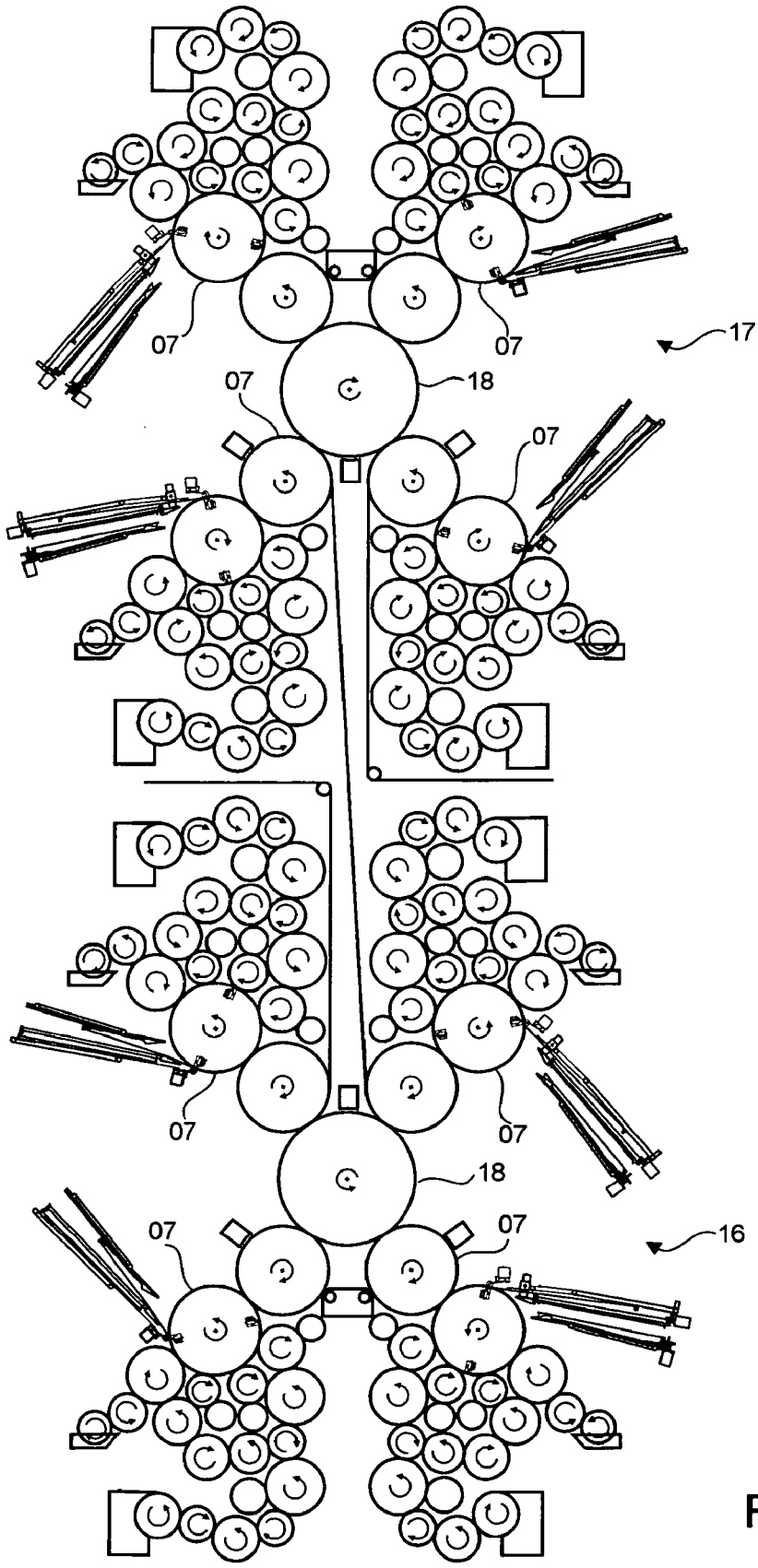

FIG. 20 shows an embodiment of a printing tower with two nine-cylinder satellite printing units 16; 17 situated one above another. The two satellite cylinders 18 each have twice the diameter of the assigned forme cylinder 07. FIG. 21 shows a further embodiment of a printing tower with two nine-cylinder satellite printing units 16; 17 situated one above another. In this configuration the two satellite cylinders 18 have 1.5 times the diameter of the assigned forme cylinder 07.

Figure 22:
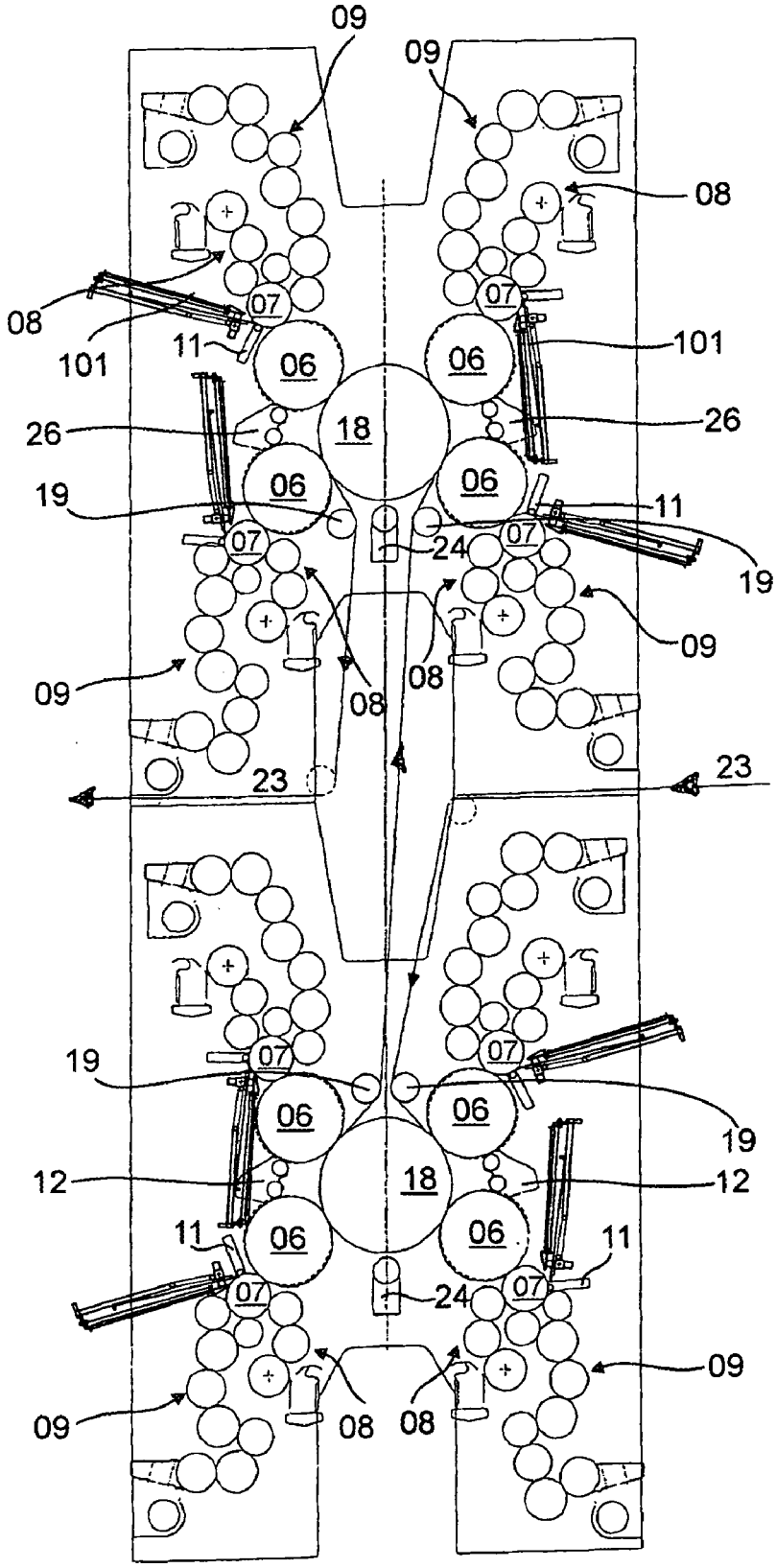
FIG. 22 two nine-cylinder satellite printing units arranged one above another.

FIG. 22 shows a further embodiment of a printing tower with two nine-cylinder printing units 16; 17 situated one above another. In this configuration the two satellite cylinders 18 each have 3 times the diameter of the assigned forme or plate cylinders 07. The forme or plate cylinders 07, particularly as in the previous preferred embodiment, each have the circumference of two newspaper pages, preferably twice the circumference of the plate cylinder 07. The satellite cylinder 18 has 1.5 times the circumference of the transfer cylinder 06.

The nine-cylinder satellite printing unit 16; 17; 18 is preferably situated in a newspaper printing press, so that the printing plates 101 preferably each have the size of one vertical newspaper page in broadsheet format and/or two horizontal newspaper pages in tabloid format.

The plate changing device 11; 11*a*; 11*b* can be stationary or can be movable in the frame 02, such as, for example, for maintenance of, for example, the dampening unit 08.

While preferred embodiments of printing units comprising a plurality of printing groups, and a printing tower, in accordance with the present invention, have been set forth fully and completely hereinabove, it will be apparent to one of skill in the art that various changes, for example, in the specific frame structures for the printing towers, the configurations of the inking units and of the dampening units, and the like could be made without departing from the true spirit and scope of the present invention which is accordingly to be limited only by the appended claims.

What is claimed is:

1. A printing unit comprising a first printing group including at least a first printing group plate cylinder having a first axis of rotation;

a second printing including at least a second printing group plate cylinder having a second axis of rotation, said first printing group plate cylinder and said second printing group plate cylinder being arranged side by side in a horizontal direction and with a horizontal line passing through said first and second axes of rotation;

an inking unit including an ink forme roller for each said first and second printing group, each said ink forme roller being situated to cooperate directly with said printing group plate cylinder of each said printing group;

an additional cylinder in direct contact with each said plate cylinder of each of said at least first and second printing groups;

an impression cylinder cooperating with said additional cylinders of said first and second printing groups and configured as a satellite cylinder;

a first plate changing device for said first printing group and having a first front section facing said first plate cylinder;

a second plate changing device for said second printing group and having a second front section facing said second plate cylinder, one of said first and second front section being situated above said horizontal line and the other of said first and second front sections being situated below said horizontal line; and an infeed plane and a removal plane for each of said first and second plate changing devices, wherein said infeed plane is above said removal plane for one of said first and second plate changing devices and said infeed plane is below said removal plane for the other of said first and second plate changing devices.

2. The printing unit according to claim 1 further including a separate dampening unit for each of said first and second printing groups, each said dampening unit including a dampening agent roller having a dampening agent roller axis of rotation and wherein a first circumferential section of each plate cylinder is defined by a first straight line that connects said rotational axis of each plate cylinder to a rotational axis of each additional cylinder, and by a second straight line that connects said rotational axis of each plate cylinder to said rotational axis of said dampening agent roller of said dampening unit that cooperates directly with each plate cylinder and further wherein a second circumferential section of each plate cylinder is defined by a third straight line that connects the rotational axis of the plate cylinder to said rotational axis of each ink forme roller of each inking unit and by said second straight line that connects said rotational axis of each plate cylinder to said rotational axis of each dampening agent roller of the dampening unit said plate changing device of one of said first and second plate cylinders being situated in said first circumferential section, and said plate changing device of the other of said first and second plate cylinders being situated in said second circumferential section.

3. The printing unit according to claim 2 further wherein a third circumferential section of each plate cylinder is defined by said first straight line that connects said rotational axis of each plate cylinder to a rotational axis of each additional cylinder and by said straight line that connects said rotational axis of each plate cylinder to said rotational axis of each ink forme roller of each inking unit.

4. The printing unit according to claim 3 wherein said first, second, and third circumferential sections do not overlap.

5. The printing unit according to claim 3 wherein said first, second, and third circumferential sections are situated directly adjacent to one another.

6. The printing unit according to claim 3 wherein said the first, second, and third circumferential sections make up the entire circumference of the plate cylinder.

7. The printing unit according to claim 1 wherein an opening angle between a fifth straight line that connects a rotational axis of said satellite cylinder to a rotational axis of a first one of said additional cylinders and a sixth straight line that connects said rotational axis of said satellite cylinder to a rotational axis of an additional one of said additional cylinders, which is situated above said first one of said additional cylinders measures between 90° and 40°.

8. The printing unit according to claim 1 further including third and fourth printing groups, each having a printing group plate cylinder and further having an additional cylinder cooperating with its respective one of said plate cylinders, rotational axes of said four additional cylinders defining the corners of a rectangle.

9. The printing unit according to claim 1 wherein each said plate changing device has at least one contact pressure element which is usable for pressing a printing plate against a respective plate cylinder.

10. The printing unit according to claim 9 wherein each said at least one contact pressure element is at least one pressure roller.

11. The printing unit according to claim 9 wherein each said at least one contact pressure element is situated one of above said horizontal line and below said horizontal line.

12. The printing unit according to claim 1 wherein a plurality of printing plates are arranged side by side in each said plate changing device, viewed axially along each said plate cylinder.

13. The printing unit according to claim 12 wherein at least one contact pressure element is assigned to each of the printing plates arranged side by side in each said plate changing device.

14. The printing unit according to claim 13 wherein each said at least one contact pressure element that is assigned to each said printing plate is actuable independently from other ones of said contact pressure elements assigned to other ones of said printing plates.

15. The printing unit according to claim 1 wherein said infeed plane of each said plate changing device and horizontal line forms an angle that lies between 0° and 40°.

16. The printing unit according to claim 15 wherein said angle is less than 30°.

17. The printing unit according to claim 1 wherein said removal plane of each said plate changing device and said horizontal line forms an angle that lies between 0° and 40°.

18. The printing unit according to claim 17 wherein said angle is smaller than 30°.

19. The printing unit according to claim 1 wherein each said plate changing device has a plurality of chute type areas for printing plates.

20. The printing unit according to claim 19 wherein at least two of said chute-type areas are arranged side by side.

21. The printing unit according to claim 20 wherein a number of said chute-type areas lying side by side corresponds to a number of printing plates arranged side by side in an axial direction on an assigned one of said plate cylinders.

22. The printing unit according to claim 19 wherein in each said plate changing device, two of said chute-type areas are situated one above another.

23. The printing unit according to claim 22 wherein one of said two chute-type areas lying one above another each said plate changing device is an infeed chute and the other of said two chute-type areas lying one above another is a removal chute.

24. The printing unit according to claim 23 wherein each said plate changing device comprises a number of side-by-side ones of said infeed chutes that corresponds to a number of printing plates on the assigned one of said plate cylinder, and a corresponding number of ones of said removal chutes situated one of above and below said infeed chutes.

25. The printing unit according to claim 24 wherein number of said infeed chutes arranged side by side in each said plate changing device is one of two and four and six.

26. The printing unit according to claim 20 wherein said number of infeed chutes arranged side by side in each said plate changing device is one of three and five and seven.

27. The printing unit according to claim 1 wherein in each said plate cylinder has a plurality of printing plates lying side by side in an axial direction and further including a separate holding device for each said printing plate each said separate holding device being actuable independently of other ones of said separate holding devices.

28. The printing unit according to claim 1 wherein a circumference of said satellite cylinder corresponds to a whole number multiple of a respective cut-off length of each said assigned plate cylinder.

29. The printing unit according to claim 28 wherein a diameter of said satellite cylinder corresponds to n-times a respective diameter of each said assigned plate cylinder, and wherein n=0.5×a and a is a natural number that is greater than and equal to 3.

30. The printing unit according to claim 28 wherein a diameter of said satellite cylinder corresponds to m-times a respective diameter of each said assigned additional cylinder, and wherein in m=0.5×a and a is a natural number that is one of greater than and equal to 3.

31. The printing tower according to claim 1 wherein a configuration of at least one of said printing groups and said cylinders of one of said printing units is a mirror image of the configuration of at least one of said printing groups and said cylinders of another of said printing units.

32. The printing unit according to claim 1 wherein said plate changing device of one of said first and second printing units is arranged in a mirror-image configuration of the plate changing device of the other of said first and second printing units.

* * * * *